US008540106B2

(12) United States Patent
Banus

(10) Patent No.: US 8,540,106 B2
(45) Date of Patent: Sep. 24, 2013

(54) TRASH CAN WITH HANDLES THAT GRASPABLY SUPPORT A RECYCLED PLASTIC SHOPPING BAG AS A LINER

(76) Inventor: Christopher T Banus, Nashua, NH (US)

( * ) Notice: Subject to any disclaimer, the term of this patent is extended or adjusted under 35 U.S.C. 154(b) by 0 days.

(21) Appl. No.: 13/313,037

(22) Filed: Dec. 7, 2011

(65) Prior Publication Data

US 2012/0111868 A1 May 10, 2012

Related U.S. Application Data

(63) Continuation of application No. 13/220,744, filed on Aug. 30, 2011.

(60) Provisional application No. 61/411,061, filed on Nov. 8, 2010, provisional application No. 61/508,753, filed on Jul. 18, 2011.

(51) Int. Cl.
*B65D 67/12* (2006.01)
*B65D 90/00* (2006.01)

(52) U.S. Cl.
USPC ..... 220/495.08; 248/98

(58) Field of Classification Search
USPC ..... 220/495.08, 495.1, 495.11; 248/100, 248/99, 95, 101, 97; 211/12
See application file for complete search history.

(56) References Cited

U.S. PATENT DOCUMENTS 4,303,174 A * 12/1981 Anderson ..... 220/263
4,407,474 A * 10/1983 Swenson ..... 248/97
4,418,835 A 12/1983 Watts
4,437,634 A 3/1984 Hambleton
4,535,911 A * 8/1985 Goulter ..... 220/495.1
4,558,800 A 12/1985 Isgar
4,664,347 A 5/1987 Brown (Continued)

FOREIGN PATENT DOCUMENTS

EP 2042445 A1 4/2009
JP 61-093412 U 6/1986

(Continued)

OTHER PUBLICATIONS

Harriet Carter—Outlet, Grocery Bag Wastebasket, http://www.harrietcarter.com/index.cfm/fuseaction/product.detail/categoryID/F4298784- . . . , 2 pages, Oct. 11, 2010.

(Continued)

*Primary Examiner* — Anthony Stashick
*Assistant Examiner* — Kevin Castillo
(74) *Attorney, Agent, or Firm* — Maine Cernota & Rardin

(57) ABSTRACT

A trash receptacle is configured to use a shopping bag as a liner by hanging the shopping bag handles over handles or other extensions of the trash receptacle. Separating features such as protruding handle appendages and/or recessed or horizontally offset receptacle rims provide grasping spaces below the suspended bag handles into which a user's hands can be inserted for easy grasping of the bag handles during bag removal. The receptacle extensions can be fixed or removably attachable to the trash receptacle, or can be fixed to a removable receptacle adaptor. They can be curved and/or slanted inward. They can pivot inward during bag removal to relieve strain on the bag handles. Pivoting handles can be conveniently released by a foot pedal or by actuating a hand trigger while lifting the bag handles. A receptacle lid can be included, and a foot pedal can be used to operate the lid.

28 Claims, 21 Drawing Sheets

(56) References Cited

U.S. PATENT DOCUMENTS

| | | | | |
|---|---|---|---|---|
| 4,669,689 | A | 6/1987 | Jones | |
| 4,697,771 | A | 10/1987 | Majors | |
| 4,723,740 | A | 2/1988 | Courtemanche | |
| 4,728,070 | A | 3/1988 | Engelbrecht | |
| 4,735,340 | A | 4/1988 | Preston | |
| D296,258 | S | 6/1988 | Nelson | |
| 4,762,297 | A | 8/1988 | Milligan | |
| 4,763,808 | A | 8/1988 | Guhl | |
| 4,783,031 | A | 11/1988 | Ebentheuer | |
| 4,834,260 | A | 5/1989 | Auten | |
| 4,856,675 | A | 8/1989 | Palazzola | |
| 4,867,339 | A | 9/1989 | Hahn | |
| 4,892,224 | A | 1/1990 | Graham et al. | |
| 4,907,710 | A | 3/1990 | Bulkens | |
| 4,921,196 | A | 5/1990 | Rudko | |
| 4,923,087 | A | 5/1990 | Burrows | |
| 4,925,056 | A | 5/1990 | McCoig | |
| 4,930,734 | A | 6/1990 | Schmidt | |
| 4,938,380 | A * | 7/1990 | Donahoe | 220/495.1 |
| 4,946,065 | A | 8/1990 | Goulter | |
| 4,957,252 | A | 9/1990 | Watkins | |
| 4,997,149 | A | 3/1991 | Koch | |
| 5,018,637 | A | 5/1991 | Miller | |
| 5,029,926 | A * | 7/1991 | Dieterich, Jr. | 294/171 |
| D321,135 | S | 10/1991 | Bedell | |
| 5,054,724 | A | 10/1991 | Hutcheson | |
| 5,105,969 | A | 4/1992 | Lamas | |
| 5,222,704 | A | 6/1993 | Light | |
| 5,232,186 | A * | 8/1993 | Corkery | 248/97 |
| 5,246,190 | A | 9/1993 | Swirkal | |
| 5,263,672 | A | 11/1993 | He | |
| 5,299,708 | A | 4/1994 | Hallcok et al. | |
| 5,314,151 | A | 5/1994 | Carter-Mann | |
| 5,419,452 | A | 5/1995 | Mueller | |
| 5,535,914 | A | 7/1996 | Badalamenti | |
| 5,645,186 | A | 7/1997 | Powers | |
| 5,671,861 | A * | 9/1997 | Hall et al. | 220/495.08 |
| 5,711,499 | A | 1/1998 | Sectish | |
| 5,735,495 | A * | 4/1998 | Kubota | 248/100 |
| 5,803,299 | A * | 9/1998 | Sealy, Jr. | 220/495.07 |
| D401,719 | S | 11/1998 | Van Leeuwen et al. | |
| 5,881,901 | A | 3/1999 | Hampton | |
| 5,887,748 | A | 3/1999 | Mguyen | |
| 5,915,584 | A | 6/1999 | Sposit | |
| 6,102,239 | A | 8/2000 | Wien | |
| 6,123,215 | A | 9/2000 | Windle | |
| 6,237,878 | B1 | 5/2001 | Nelson | |
| 6,375,131 | B1 * | 4/2002 | Youst | 248/101 |
| 6,474,495 | B1 | 11/2002 | Frei | |
| 6,517,033 | B2 | 2/2003 | Russell et al. | |
| 6,959,833 | B1 | 11/2005 | Paul | |
| 7,080,750 | B2 | 7/2006 | Wein et al. | |
| 7,694,838 | B2 | 4/2010 | Yang et al. | |
| 2002/0096524 | A1 | 7/2002 | Hardesty | |
| 2004/0000556 | A1 | 1/2004 | Harris | |
| 2004/0200938 | A1 | 10/2004 | Forlivio | |
| 2005/0087534 | A1 | 4/2005 | Harris | |
| 2006/0163257 | A1 | 7/2006 | Golbert | |
| 2006/0213914 | A1 | 9/2006 | Victor | |
| 2007/0138184 | A1 | 6/2007 | Smith | |
| 2008/0005870 | A1 | 1/2008 | Chase | |
| 2008/0006638 | A1 | 1/2008 | Yang | |
| 2008/0197136 | A1 | 8/2008 | Dukes | |
| 2009/0020657 | A1 | 1/2009 | Dayton | |
| 2009/0050628 | A1 | 2/2009 | Sullivan | |
| 2011/0024580 | A1 | 2/2011 | McConnell | |
| 2011/0245057 | A1 | 10/2011 | Scoledes | |

FOREIGN PATENT DOCUMENTS

| | | | |
|---|---|---|---|
| JP | 2003034404 | A | 2/2003 |
| JP | 2006298595 | A | 11/2006 |
| KR | 20040085604 | A | 10/2004 |
| WO | 8805415 | | 7/1988 |
| WO | 2007075700 | A1 | 7/2007 |
| WO | 2008017229 | A1 | 2/2008 |
| WO | 2008062197 | A1 | 5/2008 |

OTHER PUBLICATIONS

PCT Search Report dated May 29, 2012 of Patent Application No. PCT/US2011/059294, filed Nov. 4, 2011.

* cited by examiner

TRASH CAN WITH HANDLES THAT GRASPABLY SUPPORT A RECYCLED PLASTIC SHOPPING BAG AS A LINER

RELATED APPLICATIONS

This application is a continuation of U.S. application Ser. No. 13/220,744, filed Aug. 30, 2011, which claims the benefit of U.S. Provisional Applications No. 61/411,061, filed Nov. 8, 2010, and No. 61/508,753, filed Jul. 18, 2011. All of these applications are herein incorporated by reference in their entirety for all purposes.

FIELD OF THE INVENTION

The invention relates to trash receptacles, and more particularly to trash receptacles that use recycled plastic shopping bags as liners.

BACKGROUND OF THE INVENTION

It is typical for a household trash receptacle to use plastic liners, so as to facilitate removal and disposal of trash, and so as to protect the interior of the receptacle from contamination by the trash, thereby reducing the frequency with which the trash receptacle must be cleaned.

Usually, a so-called plastic "trash bag" is used as a plastic liner for a trash receptacle. Plastic trash bags are readily available in a wide variety of sizes and strengths. However, use of plastic trash bags represents an expense for the consumer. Also, and perhaps more importantly, use of plastic trash bags represents a one-time use of a plastic product which consumes energy in its production and adds to the build-up of non-biodegradable waste in landfills, if the trash is buried, and/or to added air pollution from combustion of the trash bags in trash incinerators.

Another cause of wasted energy, solid waste build-up in landfills, and air pollution in incinerators is plastic shopping bags which are used to convey groceries and other purchased items from a point of sale to a consumer's home or business, and then are typically discarded (often in a trash can with a plastic trash bag liner) after this one-time use.

One approach for reducing the expense and environmental impact of plastic trash bags and plastic shopping bags is to re-use plastic shopping bags as trash bags, thereby reducing or eliminating the use of plastic trash bags. It is possible to use a plastic shopping bag as a liner in a very small, conventional trash receptacle by folding the top of the shopping bag over the rim of the trash receptacle. However, due to the small size of most plastic shopping bags, this is only possible in very small trash receptacles, as may be typically found in some household bathrooms and bedrooms.

Special trash receptacles have been proposed (and some are commercially available) which make maximal use of the volume of a plastic shopping bag by suspending the bag by its handles from appendages provided at or near the rim of the trash receptacle. This avoids the need to fold part of the plastic shopping bag over the rim of the receptacle, and allows the full volume of the shopping bag to be used for containing trash. In some of these designs, the appendages are hooks which are provided on the interior walls of the trash receptacle. However, this approach typically locates the top of the plastic shopping bag below the rim of the trash receptacle, and can thereby expose the interior of the trash receptacle to contamination by overflowing trash, if the receptacle is filled above the level of the shopping bag liner and comes into direct contact with an upper region of the trash receptacle and/or penetrates into the space between the shopping bag and the inner walls of the trash receptacle.

Another approach is to locate suspending hooks or other appendages on the outer walls of the trash receptacle, such that the handles of the plastic shopping bag are folded downward over the rim of the receptacle and hooked on the exterior appendages. This approach has the advantage that the rim of the shopping bag can be located at or slightly above the rim of the trash receptacle. However, when removing a filled shopping bag liner, it can be inconvenient and/or difficult to grasp the plastic handles of the shopping bag, and to pull them downward and away from the suspending hooks, thereby dragging the sides of the plastic shopping bag over the rim of the trash receptacle. This is especially true if the bottom of the plastic shopping bag is not fully resting on the bottom of the trash receptacle, so that the weight of trash contained in the plastic shopping bag pulls the handles of the shopping bag tightly against the suspending hooks, and increases the friction of the sides of the plastic shopping bag as they are dragged over the rim of the trash receptacle.

Yet another approach is to provide handles or other suspending appendages which extend upward from the rim of the trash receptacle, so that the plastic handles of the shopping bag can be placed over the suspending appendages such that they pull downward against the bases of the appendages and against the rim of the receptacle. This approach avoids the need to drag the sides of the plastic shopping bag over the rim of the receptacle when removing a filled liner. However, the handles of the shopping bag in this approach are typically pressed against some other structure, typically the rim of the trash receptacle at the base of the suspending appendages, especially if the bottom of the plastic shopping bag is not fully resting on the bottom of the receptacle. Hence, access to the handles is hindered either above or below the handles (or both), and it can still be difficult to grasp the handles of the plastic shopping bag so as to obtain a firm grip for lifting the filled shopping bag up and out of the trash receptacle.

What is needed, therefore, is a trash receptacle configured for using a plastic shopping bag as a liner, whereby the full volume of the shopping bag is available for filling with trash, the liner protects the interior of the trash receptacle from contamination by overflowing trash, and the handles of a filled shopping bag can be easily grasped for removal from the receptacle, even if the bottom of the shopping bag is not fully resting on the bottom of the trash receptacle.

SUMMARY OF THE INVENTION

A trash receptacle having dimensions which are appropriate for using a plastic shopping bag as a liner includes a pair of receptacle handles or other extensions which extend upward from the rim of the trash receptacle on opposing sides. The handles of a plastic shopping bag can be placed over the receptacle extensions so as to suspend the plastic shopping bag within the receptacle, with the rim of the shopping bag at or near the rim of the receptacle, thereby preventing contamination of the interior of the trash receptacle by trash which overflows the shopping bag. The trash receptacle and/or the receptacle extensions include shape features, such as protruding appendages from handles or vertical recessions or horizontal distortions of the rim of the trash receptacle, which separate the shopping bag handles from the rim of the trash receptacle and from any other nearby structures, so that a space is created both above and below each shopping bag handle, including between each shopping bag handle and the rim of the trash receptacle. The shopping bag handles are thereby easily grasped by extending the fingers of a user's hands through the spaces under and over the shopping bag handles, so that the user's fingers and thumb completely surround the shopping bag handles without displacing the handles or any nearby structures.

In some embodiments, the receptacle extensions or handles, herein also referred to as the "Basic Handle and Bag Holders" or BHBH's, are molded as part of the trash receptacle itself. In other embodiments, the handles are attachable and removable, and in some of these embodiments they can be locked into slots provided on the sides of the trash receptacle. In some of these embodiments each BHBH includes a pair of mounting pegs or tabs which can be installed in corresponding holes or slots in the rim of the trash receptacle. The BHBH's can then be secured to the trash receptacle in some of these embodiments by an adhesive or by another temporary or permanent attachment mechanism known in the art. A rim bracket can also be included which overlaps the rim of the trash receptacle and provides added stability to the BHBH once it is installed.

In similar embodiments, a portion of the BHBH extends along the inner wall of the trash receptacle, and mounting pegs attached to the extended portion can be inserted through corresponding holes in the trash receptacle so as to mount the BHBH to the trash receptacle. Some of these embodiments further include a rim bracket which overlaps the rim of the trash receptacle and stabilizes the BHBH.

Some embodiments with removable BHBH's allow the trash receptacles to be densely nested during transportation, after which they can be separated and the BHBH's can be installed by a local retailer or by a purchaser.

In various embodiments, at least portions of the BHBH's are curved and/or slanted inward toward the center of the trash receptacle. This facilitates removal of the shopping bag handles from the BHBH's by allowing some or all of the contents of the shopping bag to remain supported by the bottom of the trash receptacle as the shopping bag handles are slid off of the BHBH's.

In certain embodiments the BHBH's include lockable pivots, which can be released so as to pivot the BHBH's inward toward the center of the trash receptacle. This provides additional slack on the shopping bag handles, and ensures that the weight of trash contained in the shopping bag is fully resting on the bottom of the trash receptacle, thereby further facilitating the disengagement of the shopping bag handles from the BHBH's. In some of these embodiments the BHBH's can also be pivoted outward and downward so as to be substantially flush against the outer walls of the trash receptacle in a storage configuration when not in use. And in certain of these embodiments the pivoting BHBH's can be released to pivot inward by at least one release trigger configured so as to be conveniently operated by a hand of a user when the hand is grasping and lifting a handle of the shopping bag.

In various embodiments the trash receptacle further includes a lid which can be opened and closed without interference from the BHBH's. In some of these embodiments, the lid is operated by a foot pedal.

In certain embodiments, the BHBH's include features which enhance their attractiveness and/or the comfort with which they can be grasped.

In some embodiments, the BHBH's are attached to a rim adaptor which can at least rest on top of trash receptacle rims of various dimensions, thereby allowing the BHBH's to be used with trash receptacles of different sizes and shapes, including trash receptacles which may not have been designed for use with the present invention. Some of these embodiments include attachment mechanisms such as clips attached to the underside of the rim adaptor which attach the rim adaptor to the rim of the trash receptacle. And in some of these embodiments the attachment mechanisms are adjustable in position so as to allow the rim adaptor to be attached to trash receptacle rims having different sizes and shapes.

In certain embodiments, for example when the trash receptacle is not intended to be portable and therefore does not require handles, the BHBH's are groups of separated posts rather than handles. In some of these embodiments the posts are connected at their bases by cross struts, and are able to rotate inward about the struts when released, for example by a foot pedal, for easy removal of a shopping bag.

In various embodiments, the trash receptacle includes shape features which are cooperative with the BHBH's so as to separate the shopping bag handles from the rim of the trash receptacle. In some of these embodiments, regions of the rim of the trash receptacle immediately below the BHBH's are recessed below the level of the remainder of the rim, so as to provide grasping space below handles of a shopping bag which are suspended at or near the level of the remainder of the receptacle rim. In some of these embodiments, lower portions of the BHBH's provide a border for the recessed portions of the receptacle rim. In other embodiments, portions of the receptacle rim which are immediately below the BHBH's are horizontally offset either inward or outward from the BHBH's, so that a grasping space is formed directly beneath the suspended handles of a shopping bag.

One general aspect of the present invention is a system for suspending a plastic shopping bag as a liner within a trash receptacle. The system includes at least two receptacle extensions that are at least attachable to the trash receptacle and extend upward at two opposing locations around a rim of the trash receptacle, the receptacle extensions being of a size and shape which allows bag handles of the plastic shopping bag to be placed over the receptacle extensions and suspended thereby, thereby positioning the plastic shopping bag within an interior of the trash receptacle. The system further includes bag handle separating features that are at least cooperative with the receptacle extensions, the bag handle separating features being configured to separate a central portion of each of the suspended plastic shopping bag handles from the rim of the trash receptacle and from all other nearby structures, thereby enabling the fingers and thumbs of a user's hands to completely surround the central portions of the suspended shopping bag handles without disturbing the positions of the shopping bag handles or the nearby structures.

In embodiments, each receptacle extension is a receptacle handle which can be used for lifting and carrying the trash receptacle.

In some embodiments, each receptacle extension includes a plurality of receptacle extension posts configured to extend outward from the rim of the trash receptacle. In some of these embodiments the receptacle extension posts included in each receptacle extension are mechanically coupled to each other.

In various embodiments, the bag handle separating features include lobes which extend outward from sides of the receptacle extensions and suspend the handles of the plastic shopping bag in a location that is vertically offset above the rim of the trash receptacle. And in certain embodiments the receptacle extensions are formed as part of the trash receptacle.

In some embodiments the receptacle extensions are attachable to the trash receptacle. In some of these embodiments a mounting mechanism of the receptacle extensions does not obstruct nesting of a plurality of trash receptacles by more than one inch when the receptacle extensions are not attached to the trash receptacles. In other of these embodiments the receptacle extensions can be removed from the trash receptacle after attachment thereto. In some of these embodiments the receptacle extensions are attached to a rim adaptor, the rim adaptor being able to at least rest on top of the rim of the trash receptacle, the rim adaptor having a central opening through which the plastic shopping bag can extend from the receptacle extensions through the rim adaptor and into the interior of the trash receptacle. In some of these embodiments the rim adaptor includes an adaptor region surrounding the opening, the adaptor region being configured to enable the rim adaptor to at least rest on trash receptacle rims having at least one dimension which varies over a range of at least 10%. Other of these embodiments further include a rim adaptor attachment mechanism adapted for attaching the rim adaptor to the rim of the trash receptacle. And in some of these embodiments the rim adaptor attachment mechanism is adjustable so as to attach the rim adaptor to trash receptacle rims having at least one dimension which varies over a range of at least 10%.

In various embodiments at least a portion of each of the receptacle extensions is curved inward toward a center of the trash receptacle. In some embodiments at least a portion of each of the receptacle extensions slants inward toward a center of the trash receptacle.

In certain embodiments each of the receptacle extensions includes a hinge about which the receptacle extension can pivot. In some of these embodiments the receptacle extensions can pivot toward the interior of the trash receptacle. In other of these embodiments the receptacle extensions can pivot away from the interior of the trash receptacle.

Still other of these embodiments further include a locking mechanism cooperative with at least one of the receptacle extensions, the locking mechanism being able to maintain the receptacle extension in a fixed orientation, and a release trigger which can be actuated so as to release the locking mechanism and allow the receptacle extension to pivot. In some of these embodiments the release trigger is positioned in a location that allows the release trigger to be conveniently actuated by a hand of a user while the hand is lifting a bag handle off of a receptacle extension. In other of these embodiments the release trigger is positioned in a location which allows the release trigger to be conveniently actuated by a foot of a user while the hand is lifting a bag handle off of a receptacle extension.

Various embodiments further include a lid which can be closed so as to cover the trash receptacle, the receptacle extensions being configured so as not to interfere with operation of the lid. Some of these embodiments further include a foot pedal which is configured to open and close the lid by applying and removing foot pressure to the foot pedal.

Certain embodiments further include a grasping feature of the receptacle extensions, the grasping feature being configured so as to facilitate grasping of the receptacle extensions by hands of a user. And in some of these embodiments the grasping feature is a plurality of indentations configured so as to allow fingers of a user to rest therein.

Various embodiments further include a decorative feature of the receptacle extensions, the decorative feature being configured so as to enhance an appearance of the receptacle extensions. Certain embodiments further include a pair of side flaps which are at least attachable to opposing inner sides of the trash receptacle and which are able to overlap opposing side portions of a rim of a shopping bag so as to hold the shopping bag open when the shopping bag is suspended within the trash receptacle.

In some embodiments the bag handle separating features include a shape feature of the rim of the trash receptacle that is cooperative with a receptacle extension so as to separate a shopping bag handle suspended by the receptacle extension from the rim of the trash receptacle. In some of these embodiments the shape feature includes a vertical recession of a portion of the rim of the trash receptacle directly beneath the receptacle extension. In some of these embodiments the receptacle extension includes a border which covers the recessed portion of the rim of the trash receptacle. In other of these embodiments the shape feature includes a horizontal offset of a portion of the rim of the trash receptacle which would otherwise be beneath the receptacle extension.

Another general aspect of the present invention is a system for suspending a plastic shopping bag as a liner within a trash receptacle. The system includes a rim adaptor, the rim adaptor being able to at least rest on top of a rim of a trash receptacle, the rim adaptor having a central opening through which a plastic shopping bag can extend through the rim adaptor and into the interior of the trash receptacle. The system further includes at least two receptacle extensions at least attachable to the rim adaptor and extending upward at two opposing locations around the rim adaptor, the receptacle extensions being of a size and shape which allows bag handles of the plastic shopping bag to be placed over the receptacle extensions so as to position the plastic shopping bag through the central opening of the rim adaptor and into an interior of the trash receptacle. In addition, the system includes bag handle separating features at least cooperative with the receptacle extensions, the handle separating features being configured to provide a grasping space between the rim adaptor and the bag handles into which a user's hands can be inserted so as to facilitate grasping of the bag handles.

In embodiments, the rim adaptor includes an adaptor region surrounding the opening, the adaptor region being configured to enable the rim adaptor to at least rest on trash receptacle rims having at least one dimension which varies over a range of at least 10%.

Some embodiments further include a rim adaptor attachment mechanism adapted for attaching the rim adaptor to the rim of a trash receptacle. And in some of these embodiments the rim adaptor attachment mechanism is adjustable so as to attach the rim adaptor to trash receptacle rims having at least one dimension which varies over a range of at least 10%.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

DETAILED DESCRIPTION

Figure 1:
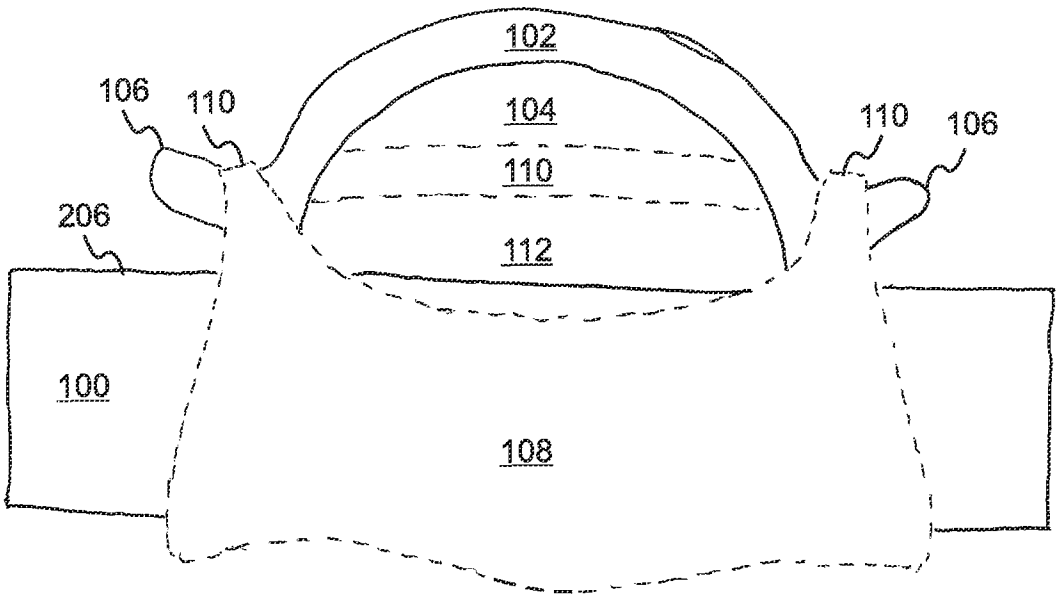
FIG. 1 is a side view of an upper portion of an embodiment of the invention, the BHBH's being formed as part of the trash receptacle.

With reference to FIG. 1, the present invention is a trash receptacle 100 which is configured to use a plastic shopping bag 108 as a liner. The trash receptacle 100 includes a pair of receptacle extensions or handles 102, also referred to herein as "Basic Handle and Bag Holders" or "BHBH's," which extend upward from opposing sides of its rim 206. The handles 110 of a plastic shopping bag 108 can be placed over the BHBH's 102 so as to suspend the plastic shopping bag 108 within the receptacle 100, with (in embodiments) the rim 208 of the plastic shopping bag 108 being at or near the rim 206 of the receptacle 100, thereby preventing contamination of the interior of the trash receptacle 100 by trash which overflows the shopping bag 108.

The trash receptacle and/or the BHBH's 102 include features which provide spaces 104, 112 above and below the handles 110 of the shopping bag, so that the handles 110 can be easily grasped. In FIG. 1, the BHBH's 102 include protruding appendages 106 which suspend the shopping bag handles 110 above the rim 206 of the trash receptacle 100, so that a space 112 is created between each shopping bag handle 110 and the underlying rim 206 of the trash receptacle 100. The shopping bag handles 110 are thereby easily grasped by insertion of a user's hands into the spaces 112 under the shopping bag handles 110 and curling of the user's fingers around the shopping bag handles 110 and into spaces 104 between the handles 110 and the tops of the BHBH's 102. This easy graspability of the shopping bag handles 110 is provided whether or not the weight of trash contained by the shopping bag 108 is resting on the bottom of the trash receptacle 100.

Figure 2A:
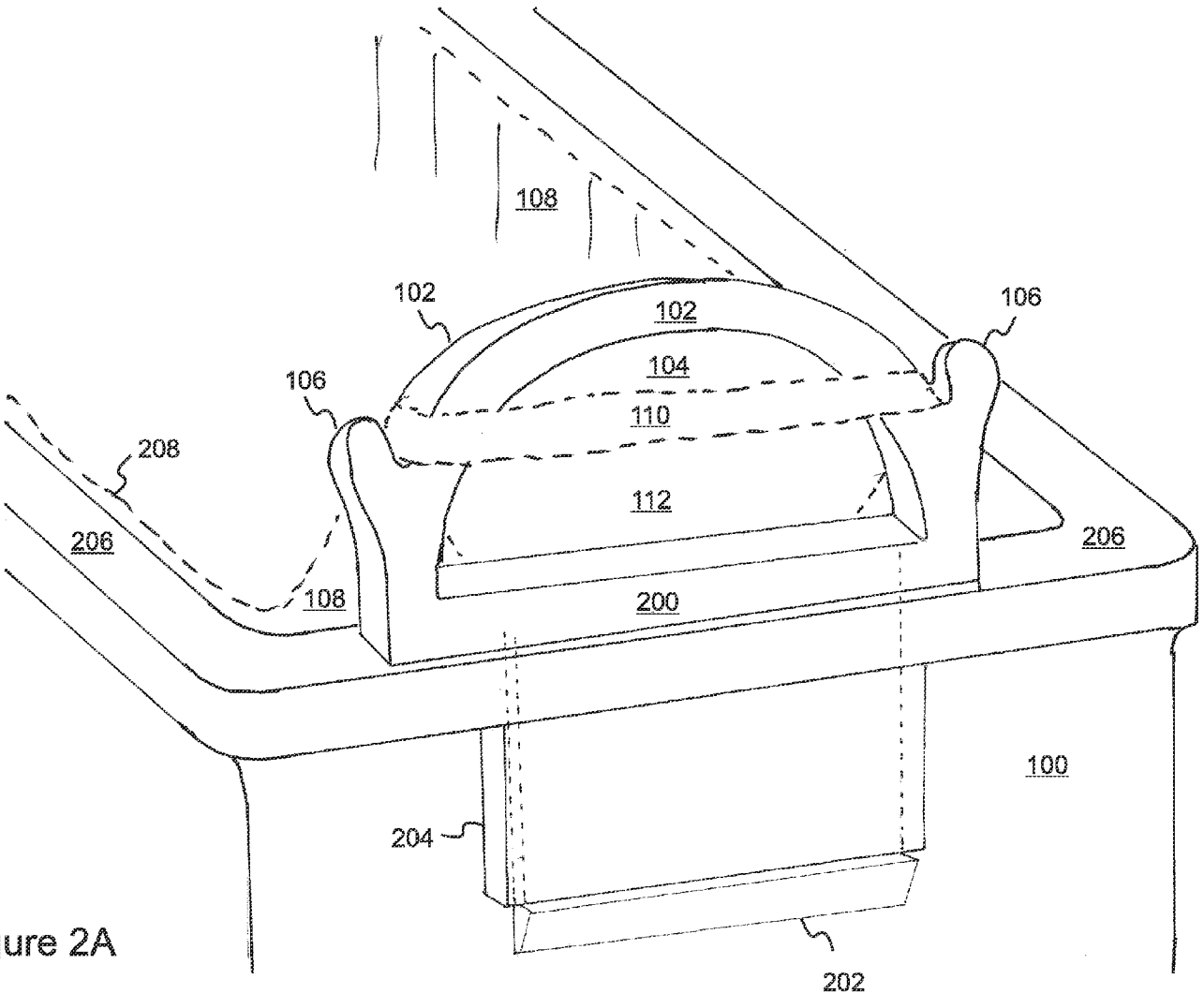
FIG. 2A is an upper perspective view of an embodiment similar to FIG. 1, except that the BHBH's are removable and lockable in slots provided on the outer walls of the trash receptacle.

In FIG. 1, the BHBH's 102 are formed as part of the trash receptacle 100 itself, for example by injection molding of plastic to form the trash receptacle 100. FIG. 2A illustrates an embodiment of the present invention wherein the BHBH's 102 are formed separately from the trash receptacle 100, and are removably attached to the trash receptacle 100 by inserting a locking tab 202 of each BHBH 102 into a corresponding channel 204 provided on the exterior walls of the trash receptacle 100, thereby holding the bases 200 of the BHBH's 102 flush against the top rim 206 of the trash receptacle 100.

Figure 2C:
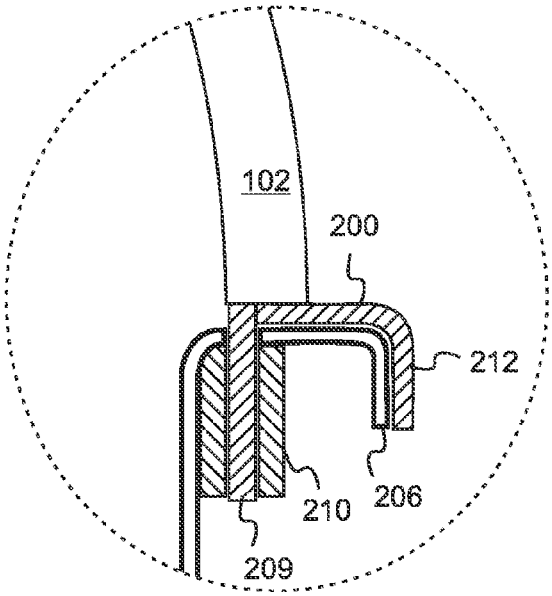
FIG. 2C is a cross sectional view of the embodiment of FIG. 2B showing a peg and rim bracket installed on the rim of the trash receptacle.
Figure 2B:
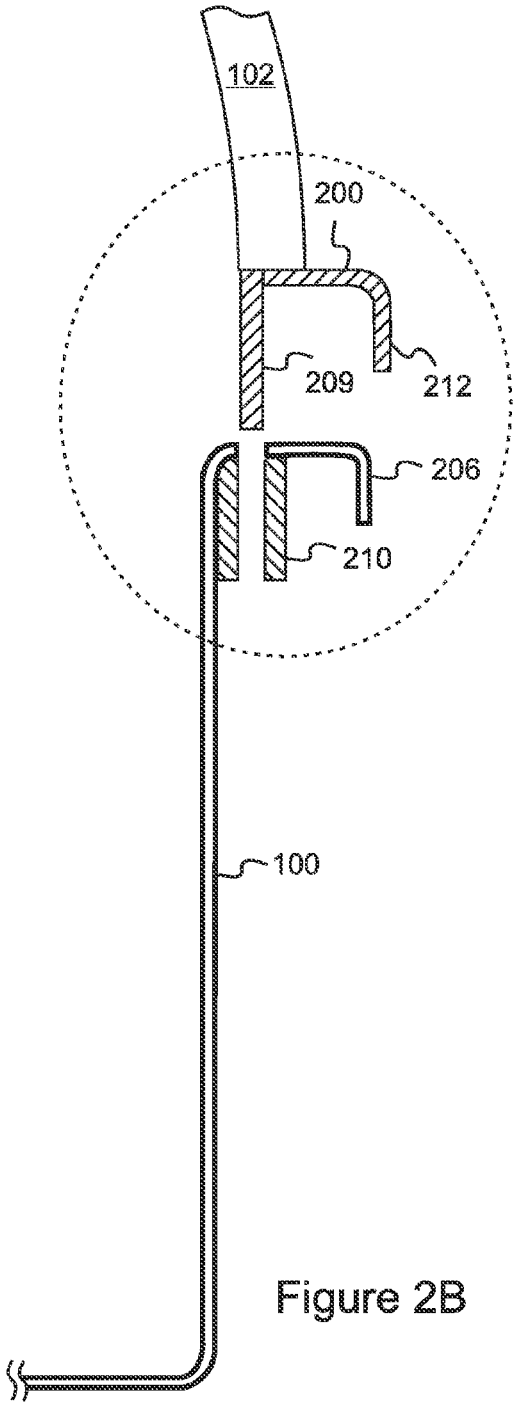
FIG. 2B is a cross-sectional side view of an embodiment in which the BHBH includes pegs and rim brackets, the pegs being insertable into corresponding holes in the rim of the trash receptacle so as to be adhered or otherwise attached in place.

FIG. 2B is a side view of another embodiment in which the BHBH's 102 are initially separate from the trash receptacle 100. In this embodiment, each BHBH includes a pair of mounting pegs or tabs 209 which can be installed in corresponding holes or slots 210 in the rim 206 of the trash receptacle. The BHBH's 102 can then be secured to the trash receptacle 100 by an adhesive or by another temporary or permanent attachment mechanism known in the art. In the embodiment of FIG. 2B, each BHBH 102 also includes a rim bracket 212 which overlaps the rim 206 of the trash receptacle 100 and provides added stability to the BHBH 102 once it is installed.

In some embodiments, the hole or slot 210 in the rim 206 of the trash receptacle extends below the top of the rim 206 by less than one inch, thereby allowing a plurality of trash receptacles 100 to be densely nested within each other during transport from a manufacturing or warehousing site, with the BHBH's 102 packaged separately (for example inside the topmost receptacle in each stack). Once the nested trash receptacles 100 have been separated, the BHBH's 102 can then be easily installed by a local merchant or by a purchaser. FIG. 2C is a cross sectional illustration of the BHBH 102 of FIG. 2B installed in the rim 206 of the trash receptacle 100.

Figure 2D:
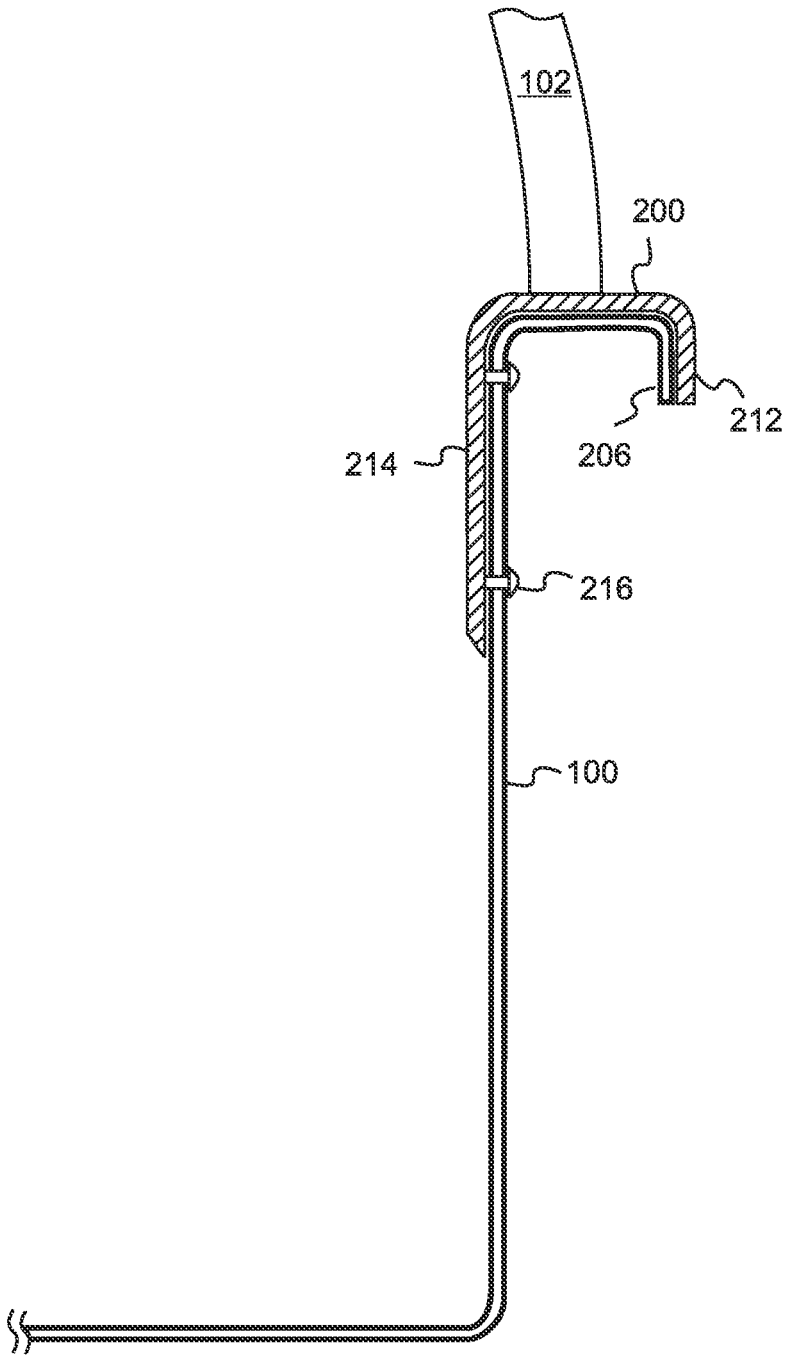
FIG. 2D is a cross sectional view of an embodiment in which the BHBH includes a rim bracket and side pegs, the side pegs being insertable into corresponding holes in the sides of the trash receptacle.
Figure 2E:
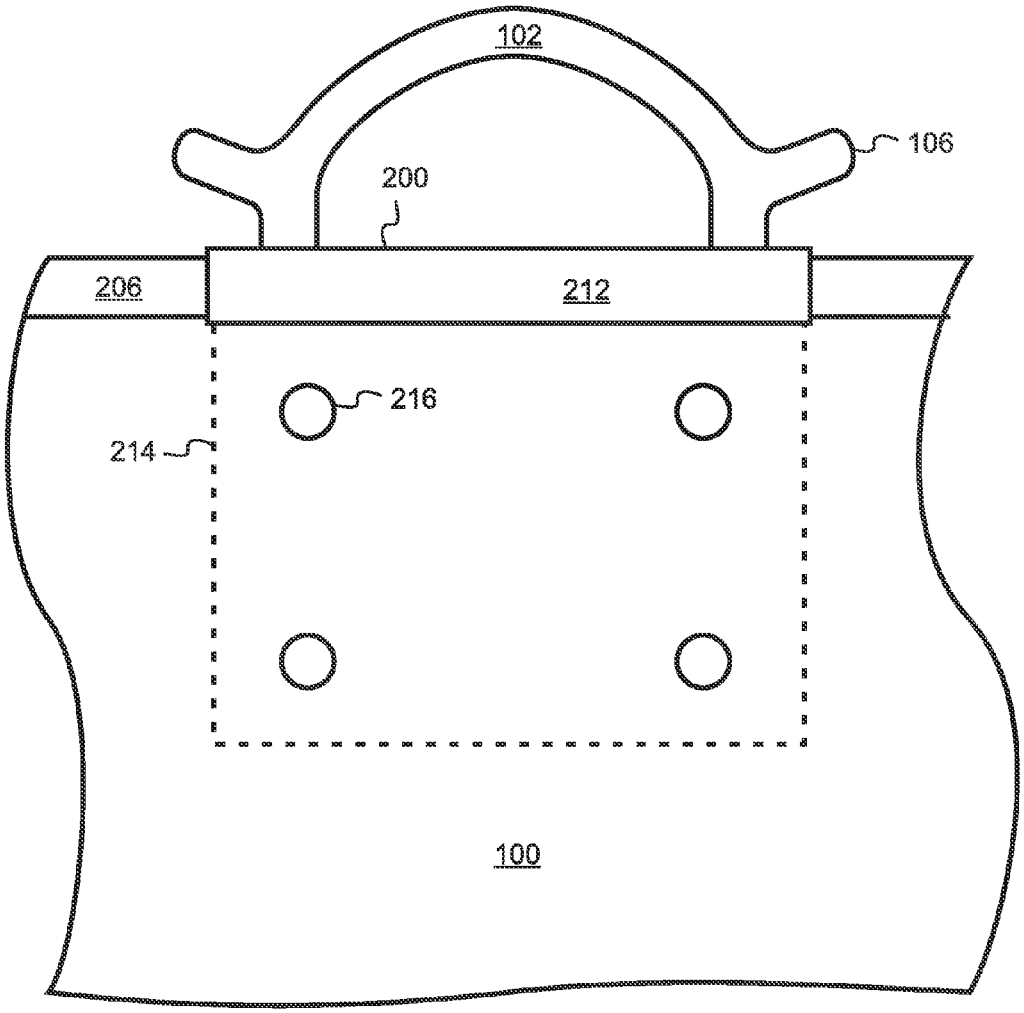
FIG. 2E is a side view of the embodiment of FIG. 2D, showing the rim bracket in place over the rim and the side pegs installed in the corresponding holes.

FIG. 2D is a cross-sectional view of yet another embodiment in which the BHBH's 102 are at least initially separate from the trash receptacle 100. As with the embodiment of FIGS. 2B and 2C, this embodiment allows the trash receptacles 100 to be densely nested during transportation, after which they can be separated and the BHBH's 102 can be installed by a local retailer or by a purchaser. In the embodiment of FIG. 2D, a portion 214 of each BHBH 102 extends along the inner wall of the trash receptacle 100, and mounting pegs 216 attached to the extended portion 214 can be inserted through corresponding holes in the trash receptacle 100 so as to mount the BHBH 102 to the trash receptacle 100. The embodiment of FIG. 2D also includes a rim bracket 212 which overlaps the rim 206 of the trash receptacle 100 and stabilizes the BHBH 102. FIG. 2E is a side view of the embodiment of FIG. 2D showing the rim bracket 212 in place and the mounting pegs 216 installed through the holes in the trash receptacle 100.

Figure 2F:
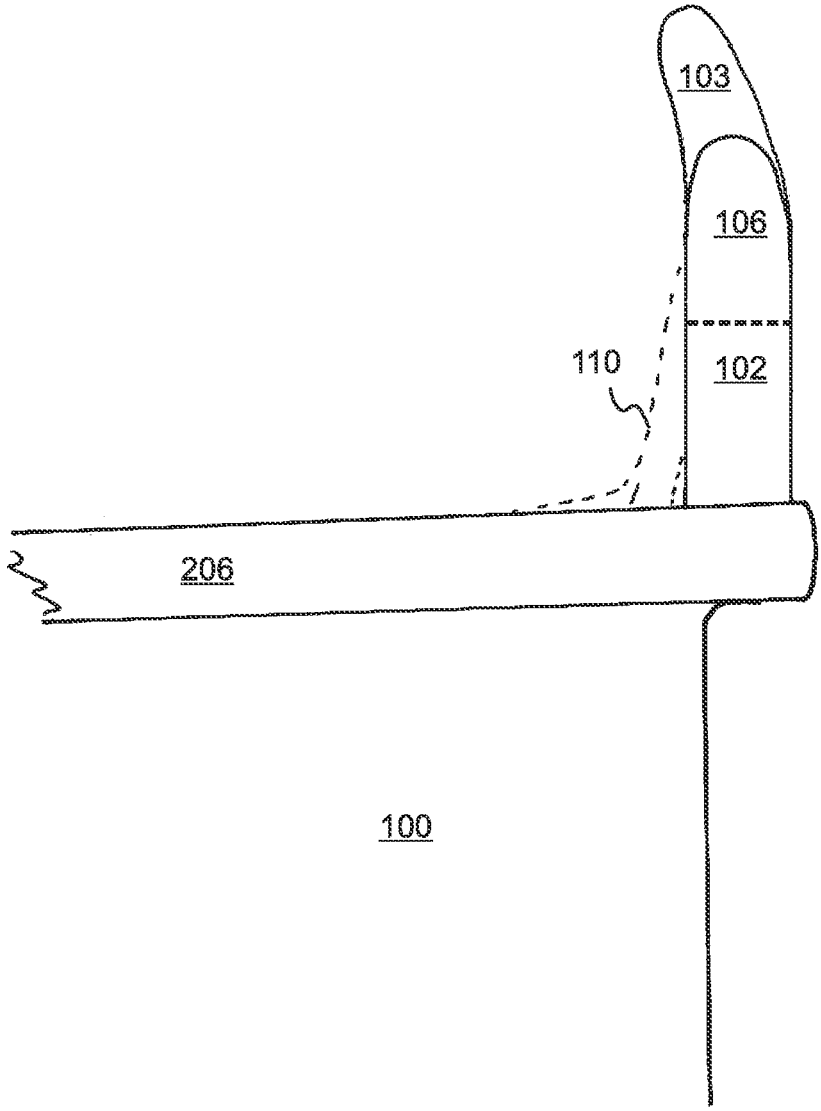
FIG. 2F is a side view of an embodiment in which an upper portion of each BHBH is curved inward toward the center of the trash receptacle.
Figure 2G:
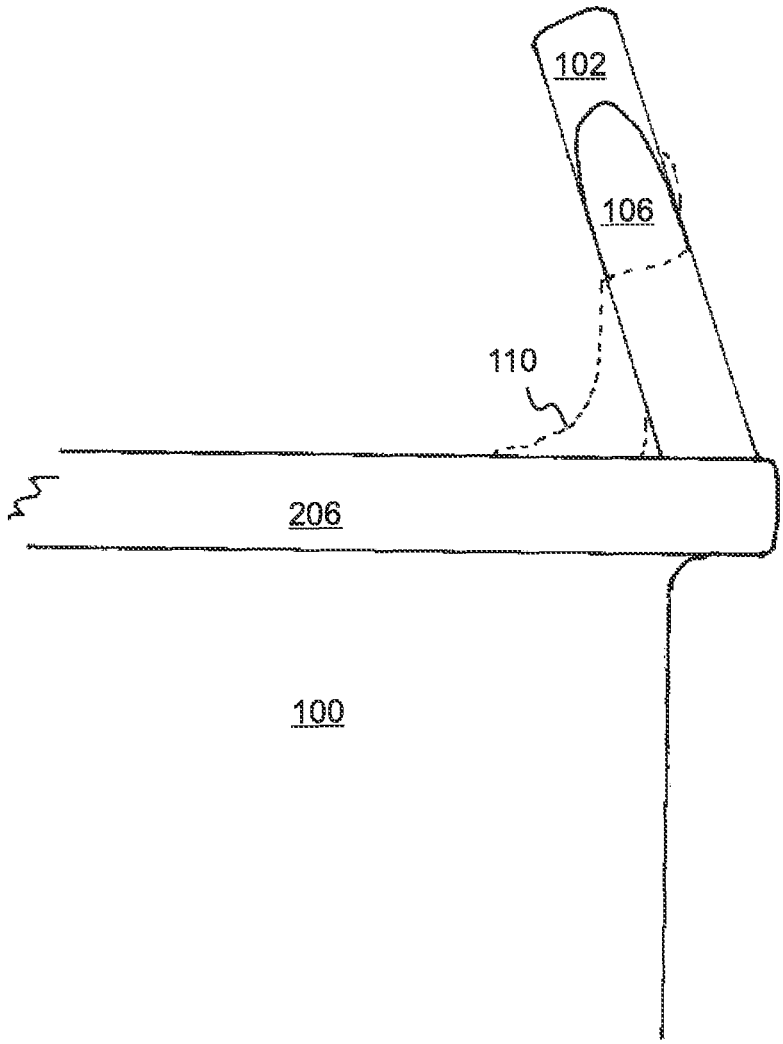
FIG. 2G is a side view of an embodiment in which each handle is slanted inward toward the center of the trash receptacle.

FIG. 2F is a side view of an embodiment in which the upper portions 103 of the BHBH's 102 (i.e. the portions which extend above the shopping bag handles 110 when the shopping bag is suspended by the BHBH's 102) are curved inward toward the center of the trash receptacle 100. FIG. 2G is a side view of a similar embodiment, in which the BHBH's 102 are straight, but are slanted toward the center of the trash receptacle 100. Of course, in some embodiments the BHBH's 102 include both curved and slanted portions. These configurations of the BHBH's 102 reduce the lifting of the shopping bag 108 as the shopping bag handles 110 are slid over and off of the BHBH's 102, thereby allowing a greater portion of the weight of the contents of the shopping bag 108 to remain supported by the bottom of the trash receptacle 100, and reducing the strain on the shopping bag handles 110 so as to make them easier to slide off of the BHBH's 102.

Figure 3A:
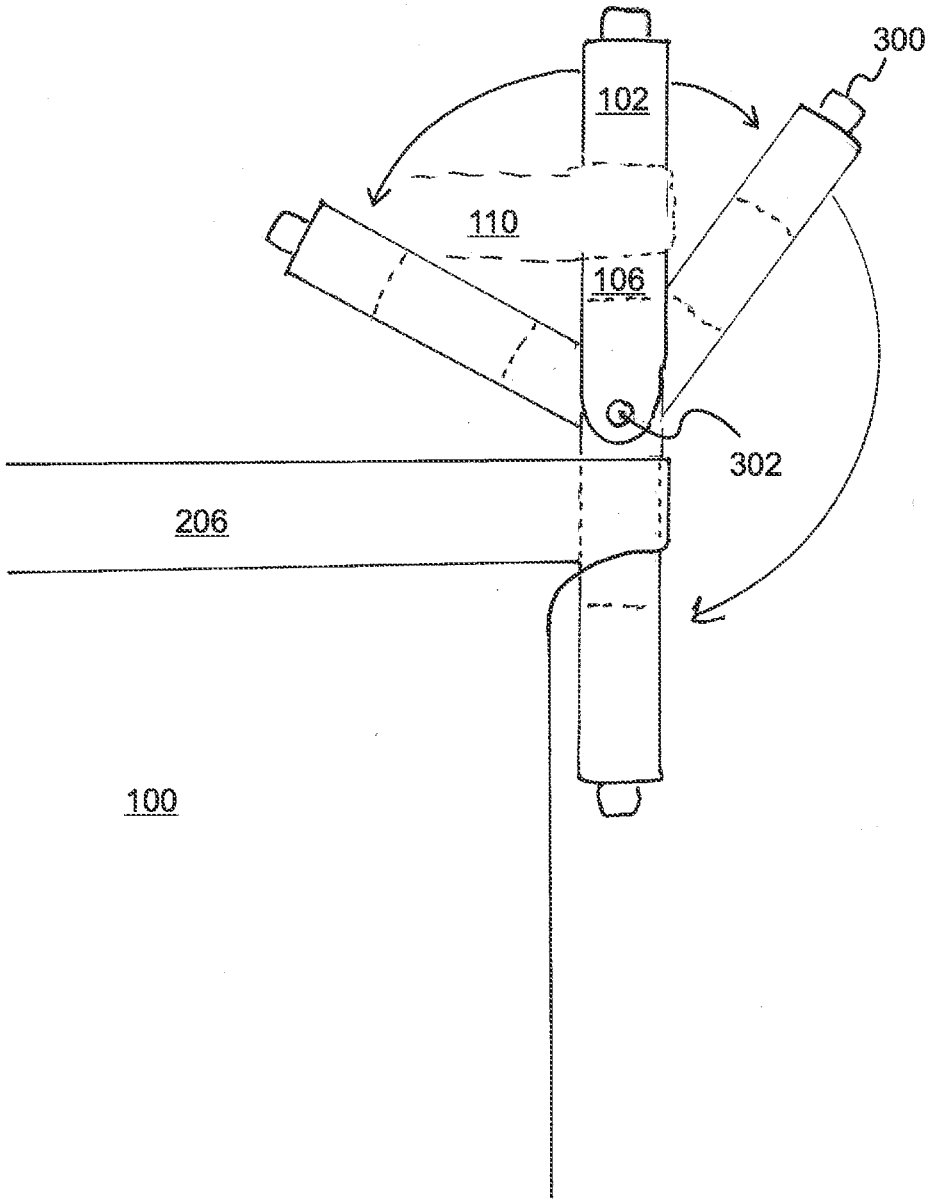
FIG. 3A is a side view of an embodiment in which the BHBH's can be pivoted toward and away from the interior of the trash receptacle.

With reference to FIG. 3A, in some embodiments the BHBH's 102 can pivot about hinges 302 toward the interior of the trash receptacle 100, so as to lower the bottom of the shopping bag liner 108 onto the bottom of the trash receptacle 100, thereby making it even easier to grasp the shopping bag handles by releasing any tension on the shopping bag handles 110 due to supporting the weight of trash contained in the shopping bag 108. In similar embodiments, the receptacle handles 102 can pivot away from the interior of the trash receptacle 100, so as to fold flush with the exterior sides of the trash receptacle 100 into a storage configuration when not in use. In the embodiment illustrated in FIG. 3A, the handles 102 can pivot in both directions. They are normally locked in position, and are released for pivoting by pressing a release button 300 provided on each handle 102.

Figure 3B:
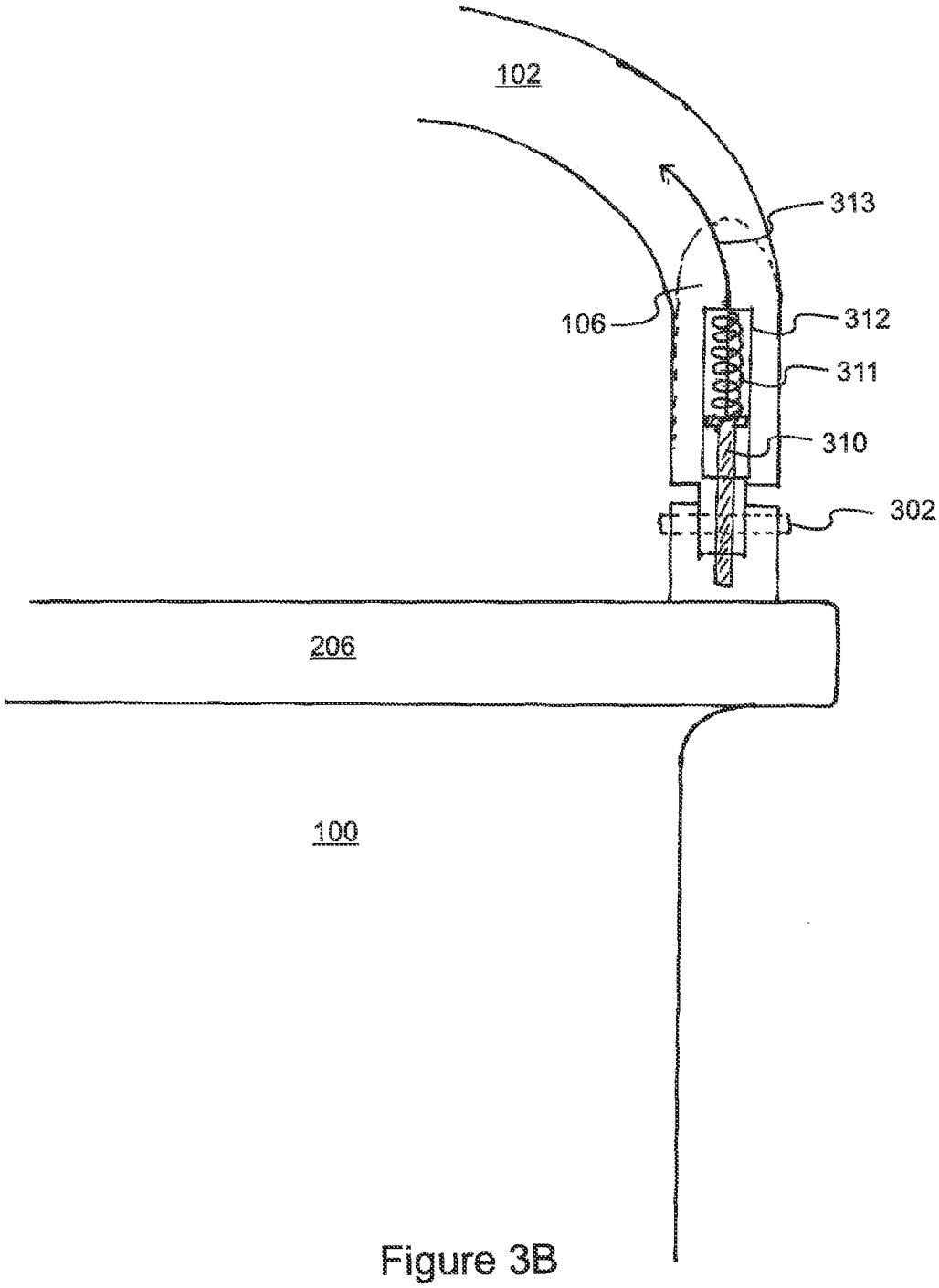
FIG. 3B is a side view of an embodiment in which the BHBH's can pivot inward toward the center of the trash receptacle when a locking pin holding the BHBH's in place is pulled upward by a string or wire.

FIG. 3B is a side view of an embodiment similar to FIG. 3A. The BHBH 102 is illustrated in the figure as being transparent, so that the locking mechanism can be seen within a cavity 312 formed in the BHBH 102. Inside of the cavity 312 a pin 310 is pressed downward by a spring 311 into a receiving hole (not shown) in the rim 206 of the trash receptacle 100. The pin 310 can be removed from the receiving hole by pulling it upward against the force of the spring 311 using a retracting wire or string 313.

Figure 3C:
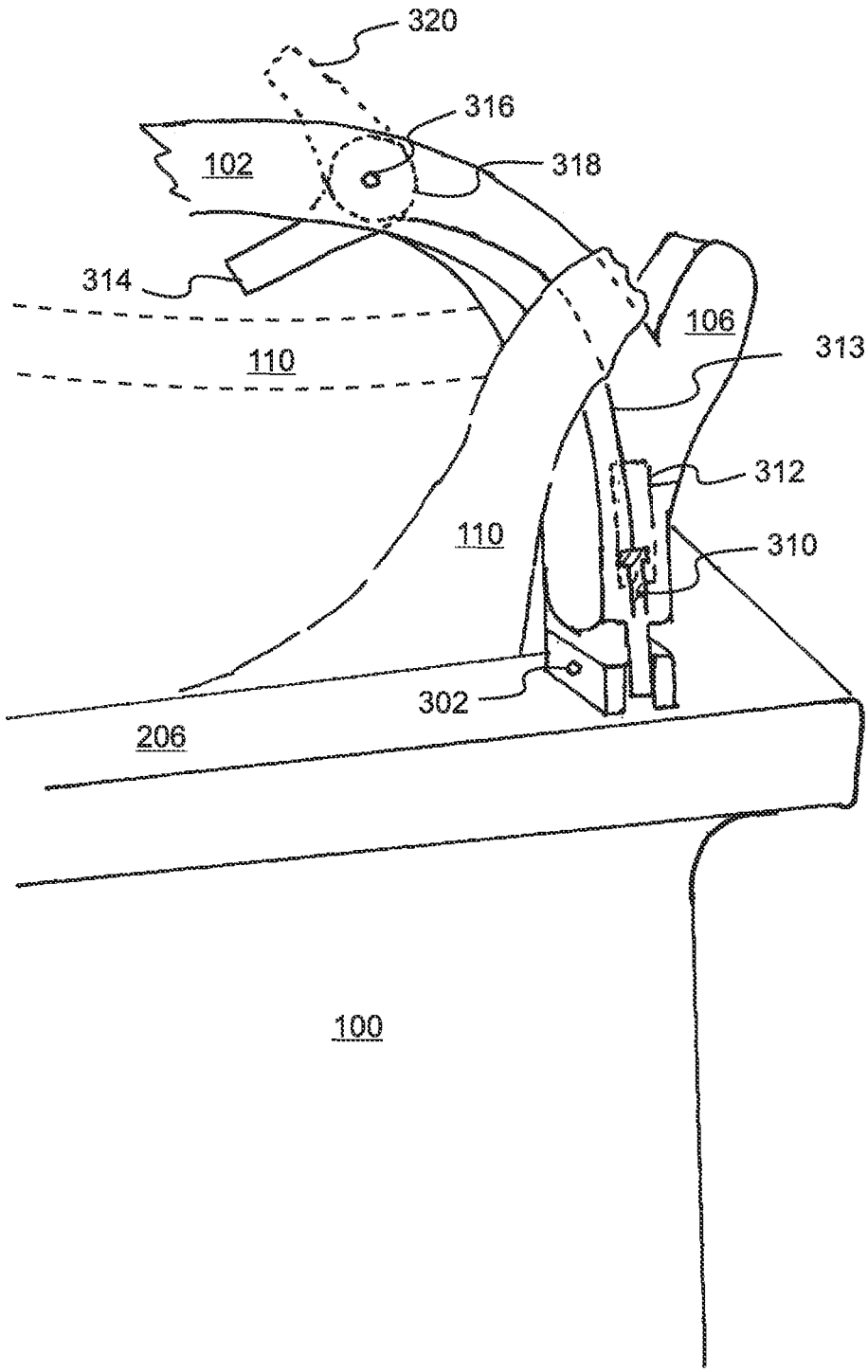
FIG. 3C is a perspective view of the embodiment of FIG. 3B showing a release trigger which can be conveniently actuated by the hands of a user grasping the handles of a suspended shopping bag.

FIG. 3C is a perspective view of the embodiment of FIG. 3B, showing a lever 314 attached by a hinge 316 to an upper portion of the BHBH 102. A pulley 318 is attached to the lever 314 and the retracting string or wire 313 is fastened to the pulley 318, so that pushing the lever 314 to its upper position 320 winds the string or wire 313 around the pulley 318 and retracts the string or wire 313, thereby removing the locking pin 310 from the receiving hole and releasing the BHBH 102 to pivot about the hinge 302. In the embodiment of FIG. 3C, the release lever 314 is positioned directly above the region where the suspended shopping bag handle 110 traverses across the BHBH 102. It is therefore very easy and convenient for a user to push up on the lever 314 and thereby release the BHBH 102 for tilting forward as the user is lifting the handle 110 of the shopping bag 108.

Figure 4:
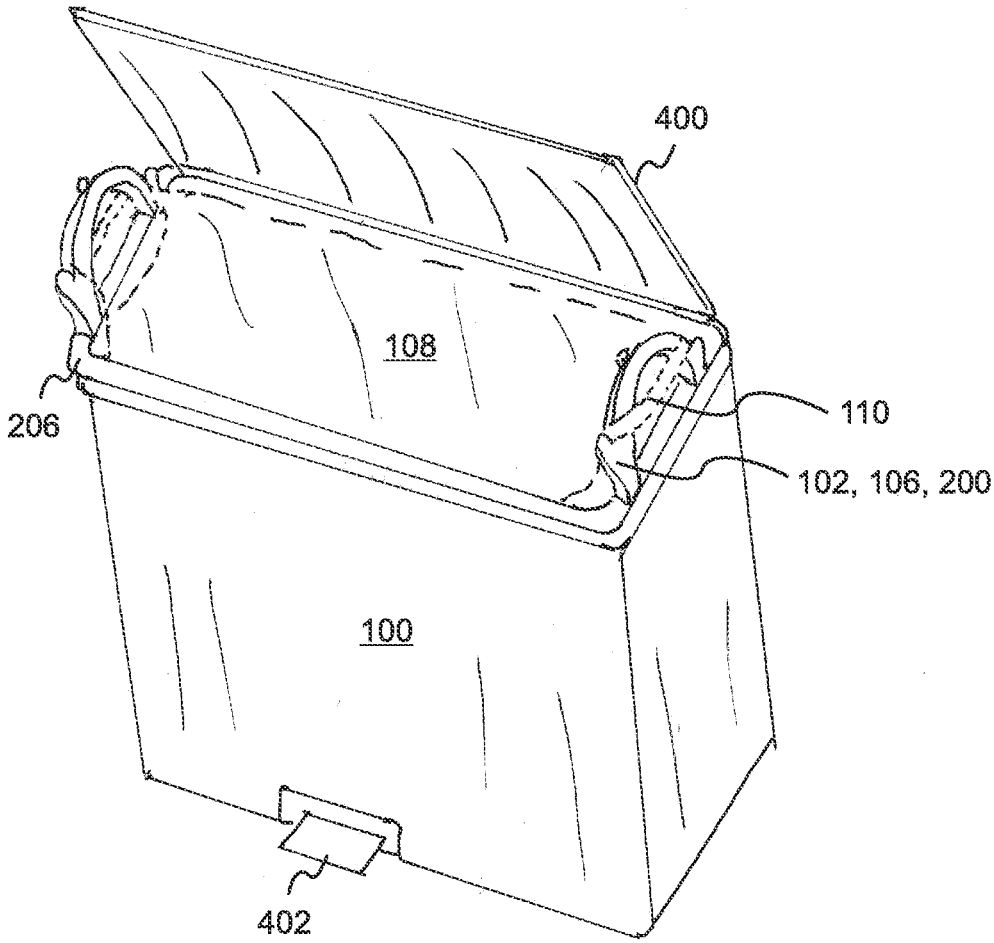
FIG. 4 is an upper perspective view of an embodiment which includes a closable lid operated by a foot pedal.

With reference to FIG. 4, in some embodiments the trash receptacle 100 includes a lid 400 that can be opened and closed as needed, without mechanically conflicting with the BHBH's 102 of the present invention. In the embodiment of FIG. 4, the lid 400 is operated by a foot pedal 402.

Figure 5:
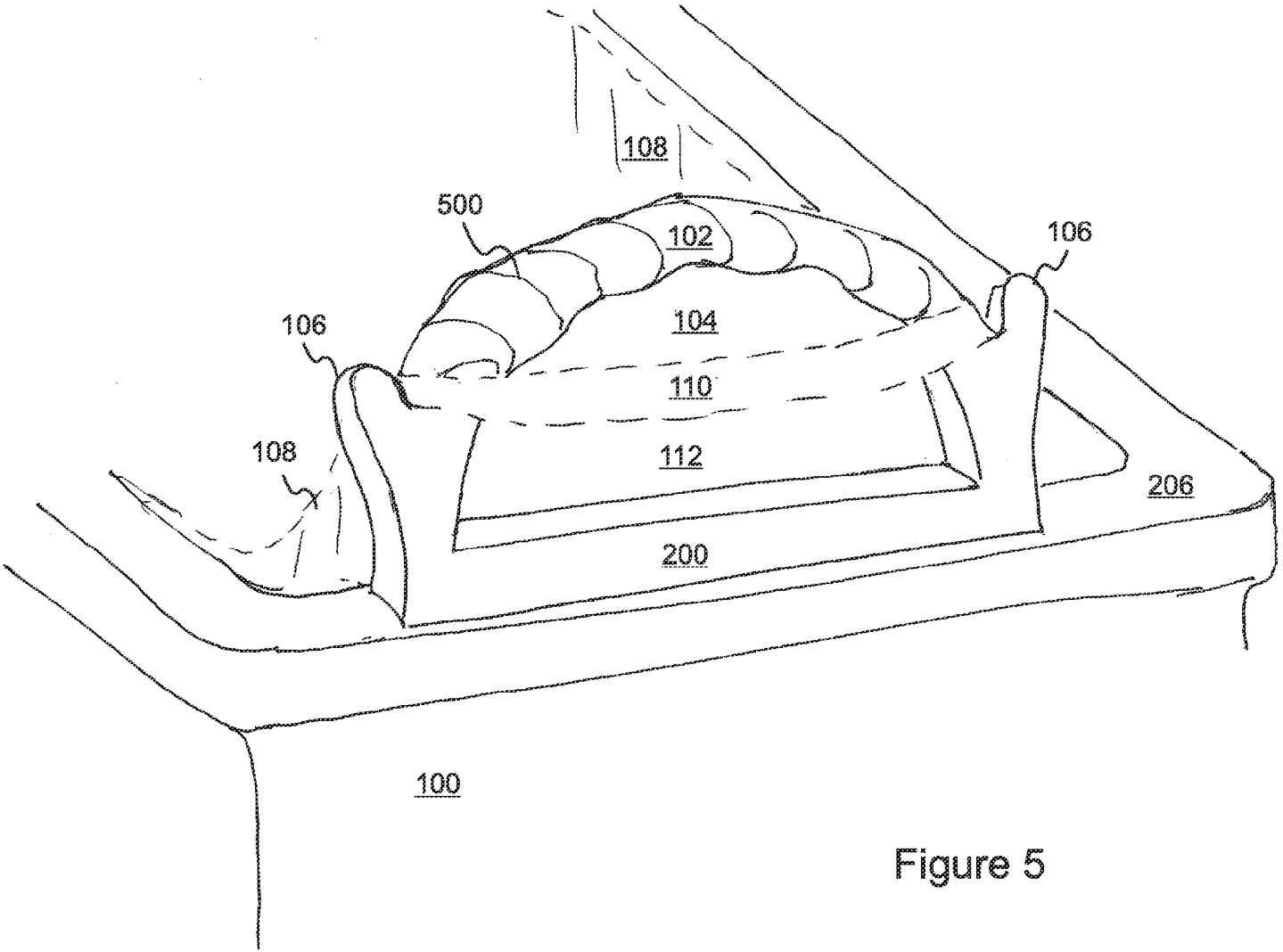
FIG. 5 is an upper perspective view of an embodiment similar to FIG. 1, but including shaping of the BHBH's which enhances grasping comfort of the BHBH handles.

With reference to FIG. 5, in various embodiments the BHBH's 102 include shaping features 500 which improve the appearance and/or the grasping comfort of the handles 102. The handles 102 of FIG. 5 include finger grooves 500 which make the handles 102 more comfortable to grasp.

Figure 6:
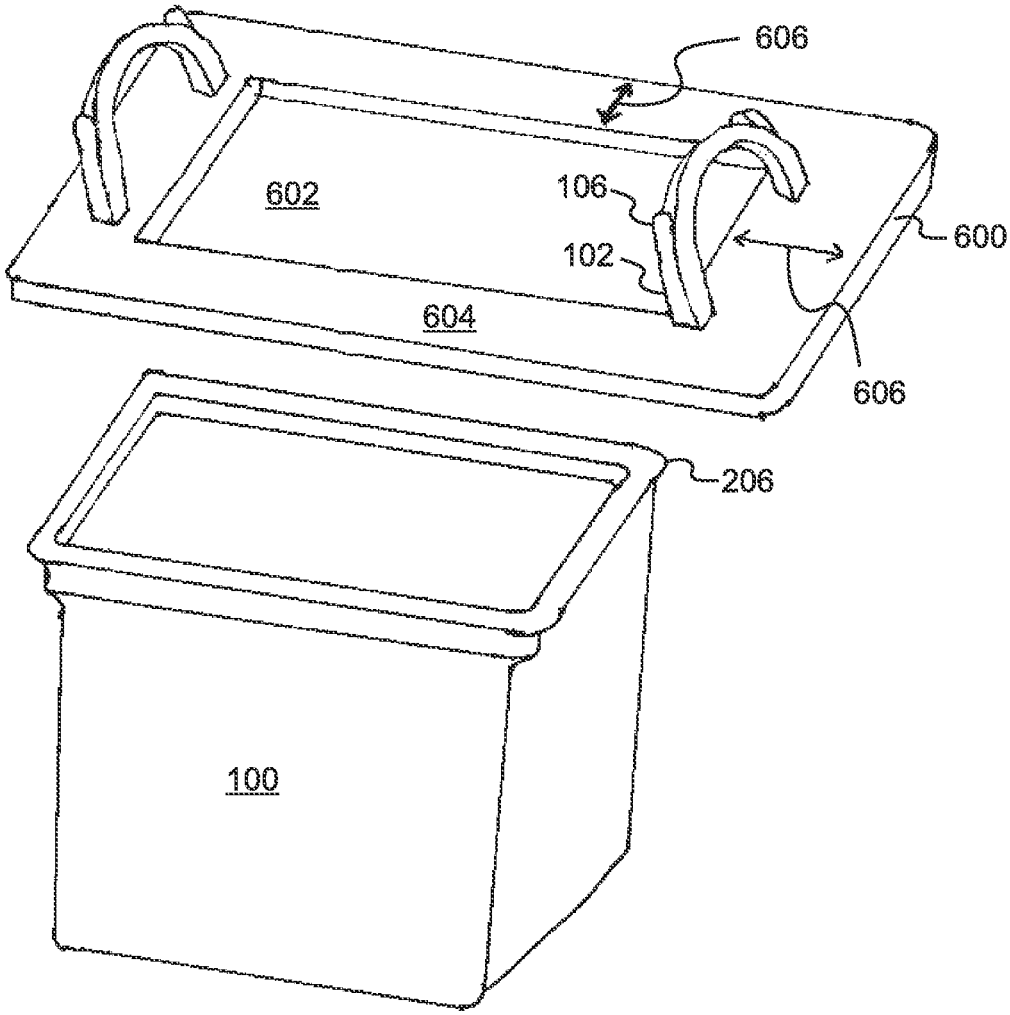
FIG. 6 is a perspective view of an embodiment in which the BHBH's are attached a lid adaptor which is able to rest on the rim of the trash receptacle.

With reference to FIG. 6, in some embodiments the BHBH's 102 are attached to a rim adaptor 600, which enables the BHBH's 102 to be used with trash receptacles 100 having rims 206 of different sizes and shapes. These can include trash receptacles 100 which were not necessarily designed for use with the BHBH's 102. In the embodiment of FIG. 6, the rim adaptor 600 includes a large central opening 602 which allows a plastic shopping bag 108 to extend from the BHBH's 102 down through the central opening 602 and into the interior of the trash receptacle 100. The lid adaptor 600 further includes an adaptor region 604 surrounding the central opening 602 having dimensions 606 which allow the rim adaptor 600 to at least rest on top of any trash receptacle having a rim 206 which will fit within the dimensions 606 of the adaptor region 604.

Figure 7:
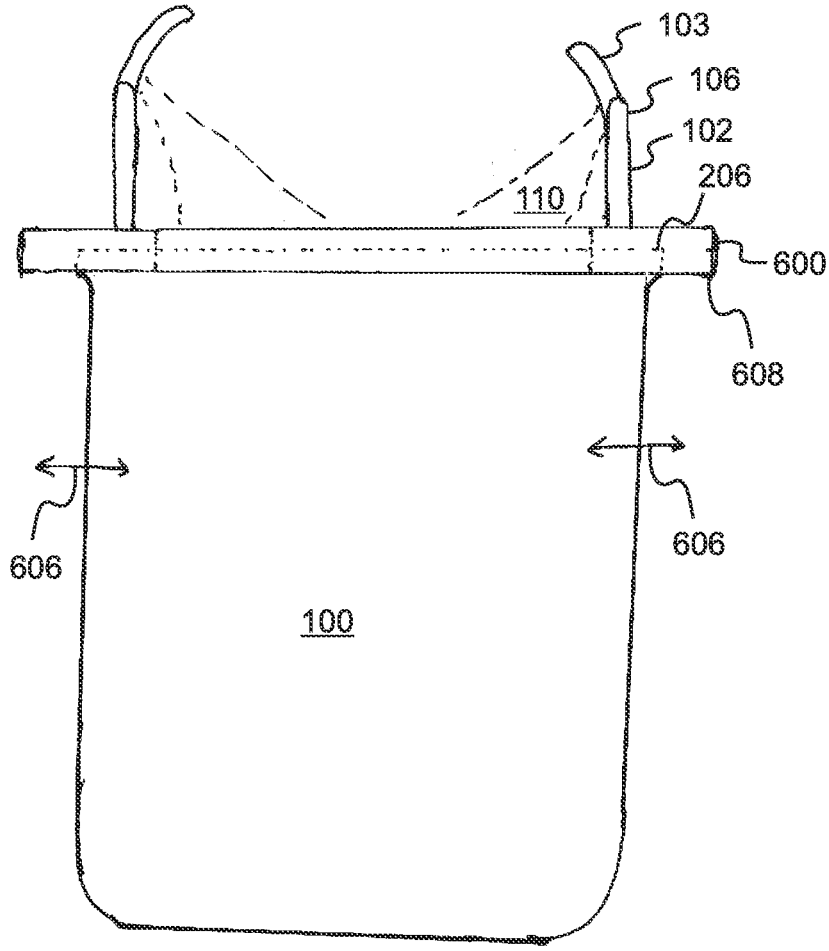
FIG. 7 is a side view of an embodiment similar to FIG. 6, wherein upper portions of the BHBH's are curved inward toward an interior of the trash receptacle.

FIG. 7 is a side view of an embodiment similar to FIG. 6 but having BHBH's which have curved upper regions 103 in the manner of FIG. 2F. The figure shows the rim adaptor 600 in place on top of the trash receptacle 100 and a plastic shopping bag 110 hanging from the BHBH's and extending through the central opening 602 into the interior of the trash receptacle 100. It can be seen in the figure that the adaptor region 604 includes an overhanging lip 608 which prevents the rim adaptor 600 from sliding off of the rim 206 of the trash receptacle 100. It can also be seen that the width of the rim 206 of the trash receptacle is within the width dimension 606 of the adaptor region 604.

Figure 8:
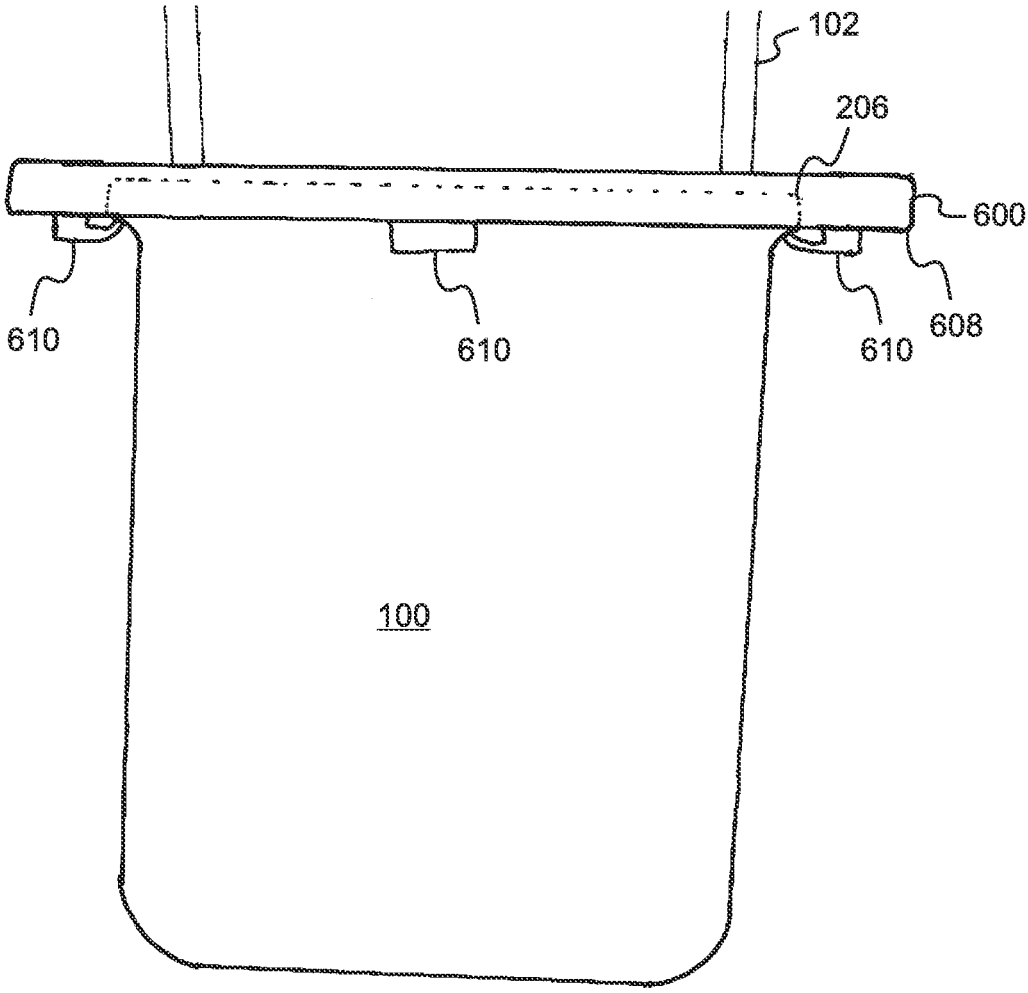
FIG. 8 is a side view of an embodiment similar to FIG. 7, but including attachment clips on the underside of the rim adaptor for attachment of the rim adaptor to the rim of the trash receptacle.

FIG. 8 is a side view of an embodiment similar to FIG. 7, except that the embodiment includes a plurality of attachment clips 610 which attach the rim adaptor 600 to the rim 206 of the trash receptacle 100. Although not visible in the figure, the attachment clips 610 are attached to tracks which allow the attachment clips 610 to be adjusted in position beneath the adaptor region 604 of the rim adaptor 600, thereby allowing the rim adaptor 600 to be attached to trash receptacles 600 having rims 206 of different dimensions.

Figure 9:
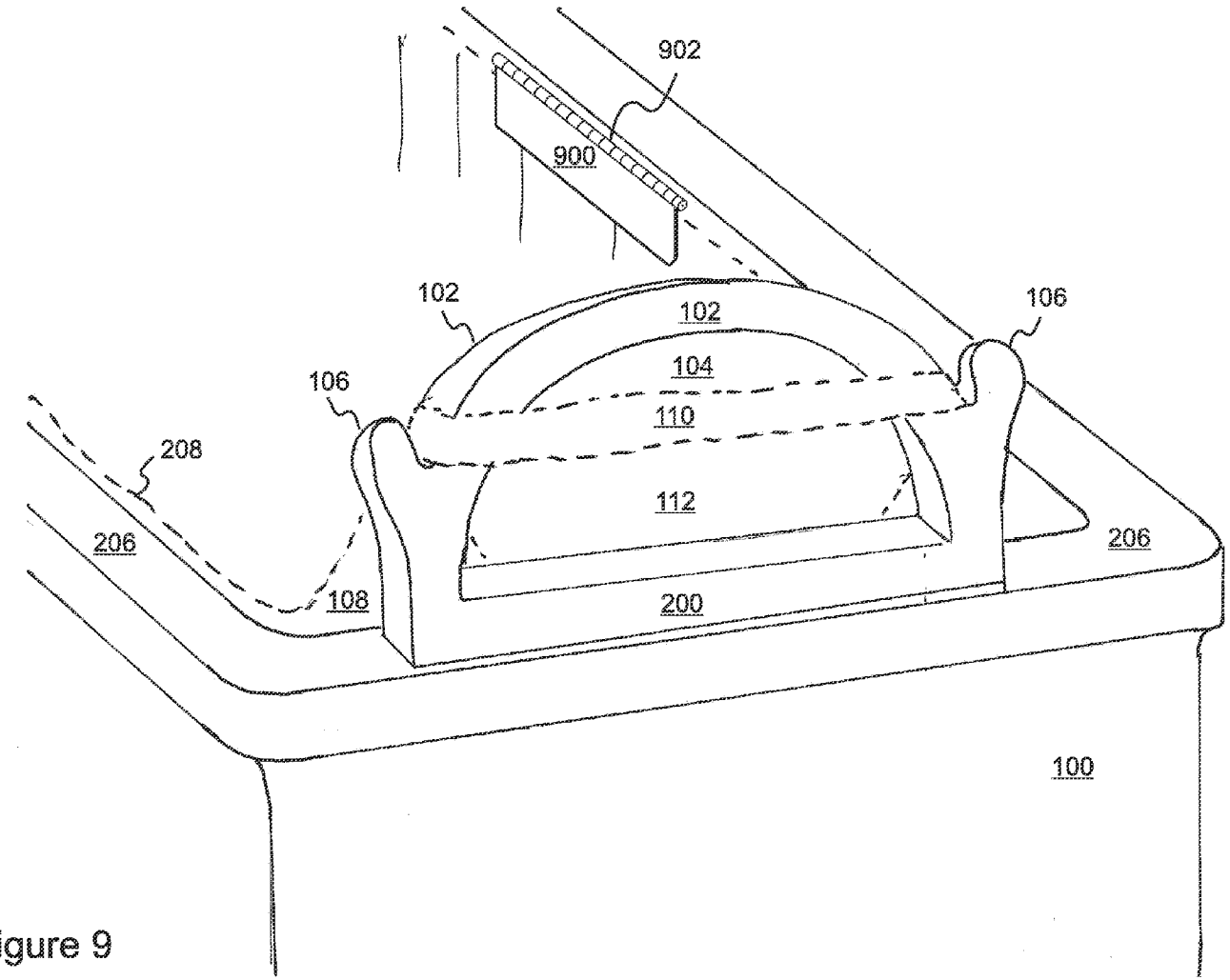
FIG. 9 is a perspective view of an embodiment that includes a side flap for holding the sides of the shopping bag open within the trash receptacle.

With reference to FIG. 9, some embodiments of the present invention include side flaps 900 which are able to hold the sides 208 of a shopping bag 102 open while the shopping bag 102 is suspended within the trash receptacle 100. The side flaps 900 can be molded as part of the trash receptacle 100 and attached by living hinges. They can be attached by insertion of pegs through holes in a manner similar to FIGS. 2D and 2E. Or they can be attached by any other mechanism known in the art. The side flaps 900 can include hinges and springs 902, as illustrated in FIG. 9, or they can be fixed but bendable for insertion and removal of the sides 208 of shopping bags 102.

In some of these embodiments the side flaps 900 can be shipped separately so as to avoid interfering with nesting of the trash receptacles 100 during transit, and then installed by a local retailer or by a purchaser after the receptacles 100 have been separated.

Figure 10:
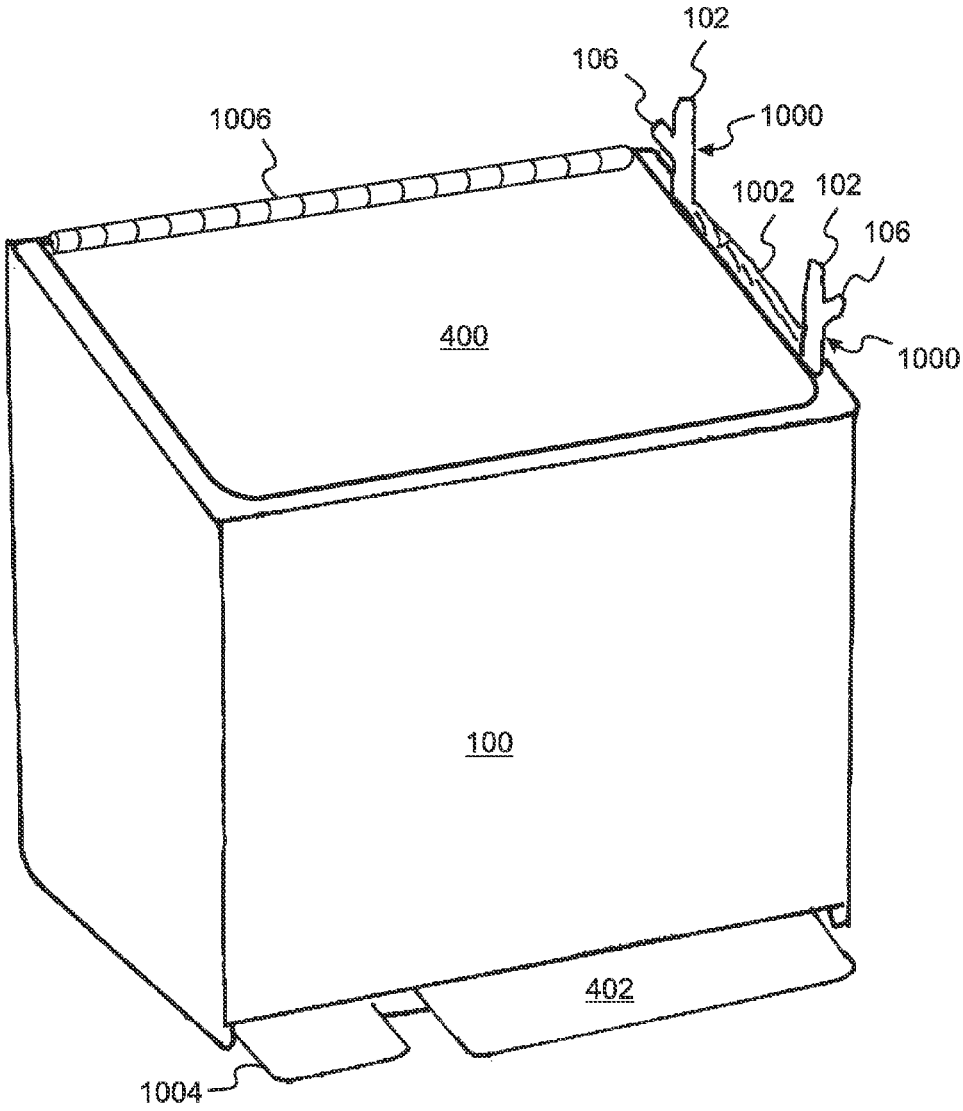
FIG. 10 is a perspective view of an embodiment in which the BHBH's are separate posts which do not form handles, the posts being releasable from the trash receptacle by a foot pedal.

FIG. 10 is a perspective view of an embodiment which includes a lid 400 which can be opened by a foot pedal 402, in a manner similar to FIG. 4. This embodiment illustrates a trash receptacle 100 which is not intended to be portable, and which therefore does not require handles. The BHBH's 102 in this embodiment are separate posts 1000, rather than handles. In various embodiments, they are either formed together with the trash receptacle 100 or they are separate and are either temporarily or permanently attachable to the trash receptacle 100. Embodiments include any of the various attachment mechanisms described above for "handle" BHBH's 102. In the embodiment of FIG. 10, pairs of BHBH's 1000 are connected at their bases by cross struts 1002, and are able to rotate inward about the struts when released by a foot pedal 1004, for easy removal of a shopping bag 102. In some embodiments, the release and tipping mechanisms operate in a manner similar to the embodiments of FIGS. 3A through 3C. In some embodiments, the BHBH's 1000 are curved or slanted inward, in a manner similar to FIGS. 2F and 2G.

Figure 11A:
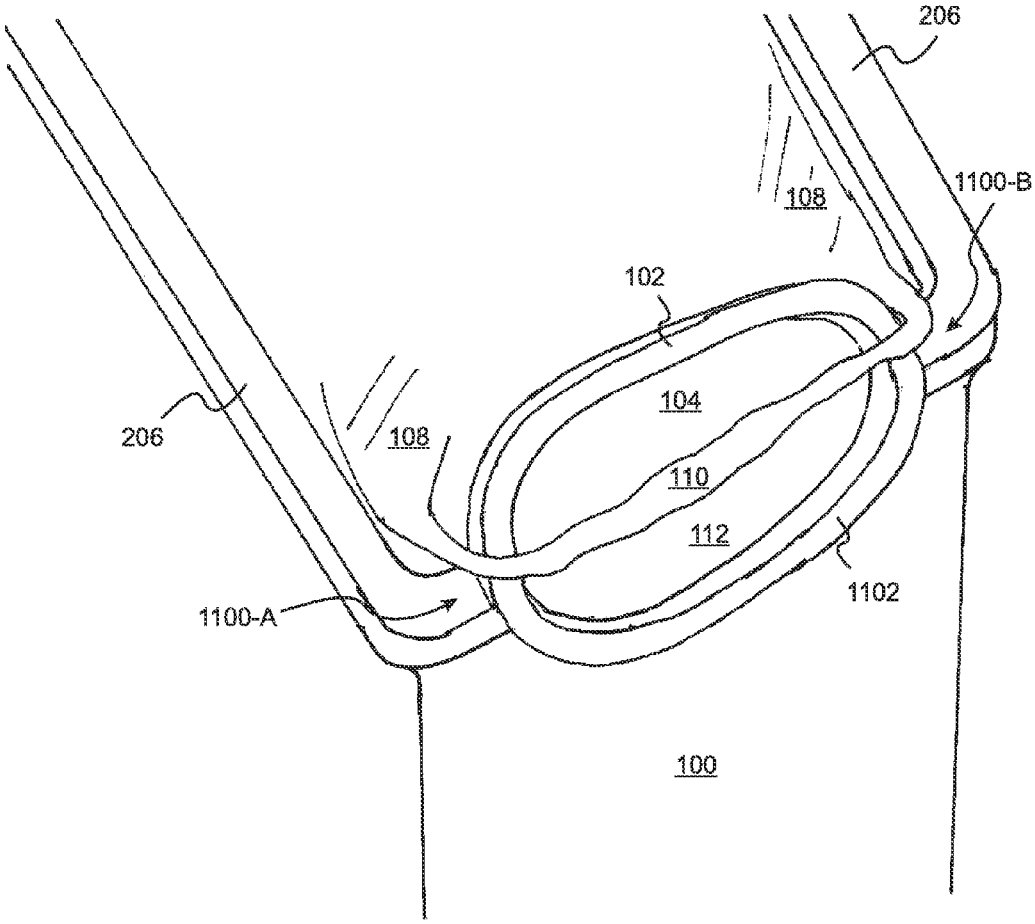
FIG. 11A is a perspective view of an embodiment in which portions of the rim of the trash receptacle are recessed below the BHBH's so as to provide grasping space below suspended shopping bag handles.
Figure 11B:
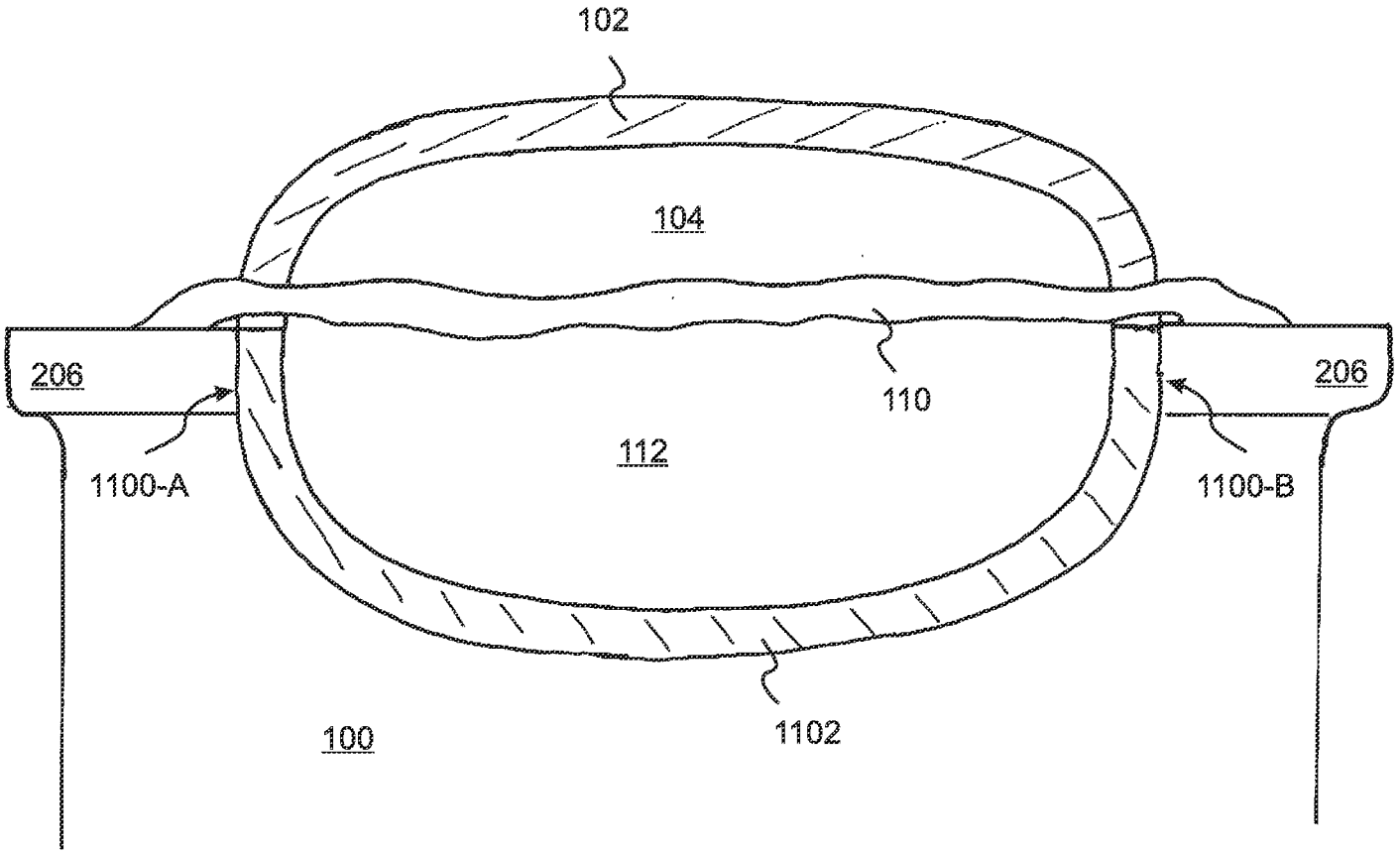
FIG. 11B is a side view of the embodiment of FIG. 11A.

In various embodiments, the trash receptacle itself includes shape features which are cooperative with the BHBH's 102 so as to provide a space 112 between the shopping bag handles 110 and the rim 206 of the trash receptacle 100. In the embodiment of FIG. 11, regions of the rim of the trash receptacle (between 1100-A and 1100-B) immediately below the BHBH's 102 are vertically recessed below a level of the remainder of the rim 206, so as to provide grasping space 112 below handles 110 of a shopping bag 108 which are suspended at or near the level of the remainder of the receptacle rim 206. In the embodiment of FIG. 11, lower portions 1102 of the BHBH's 102 provide a border 1102 for the recessed portions of the receptacle rim 102. FIG. 11B is a side view of the embodiment of FIG. 11A.

Figure 12A:
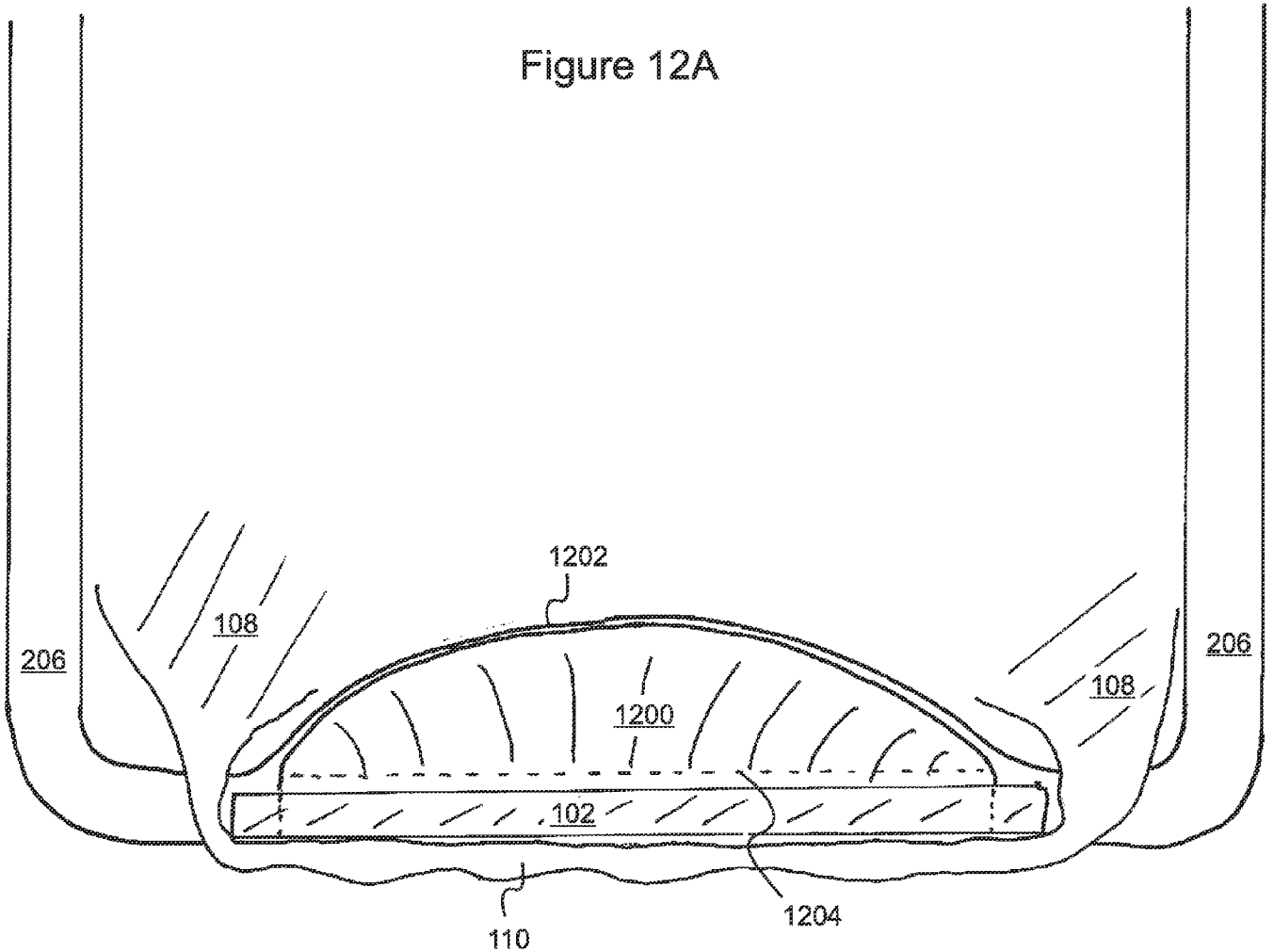
FIG. 12A is a top view of an embodiment in which portions of the rim of the trash receptacle which would otherwise be below the BHBH's are offset horizontally so as to provide grasping space below suspended shopping bag handles.
Figure 12B:
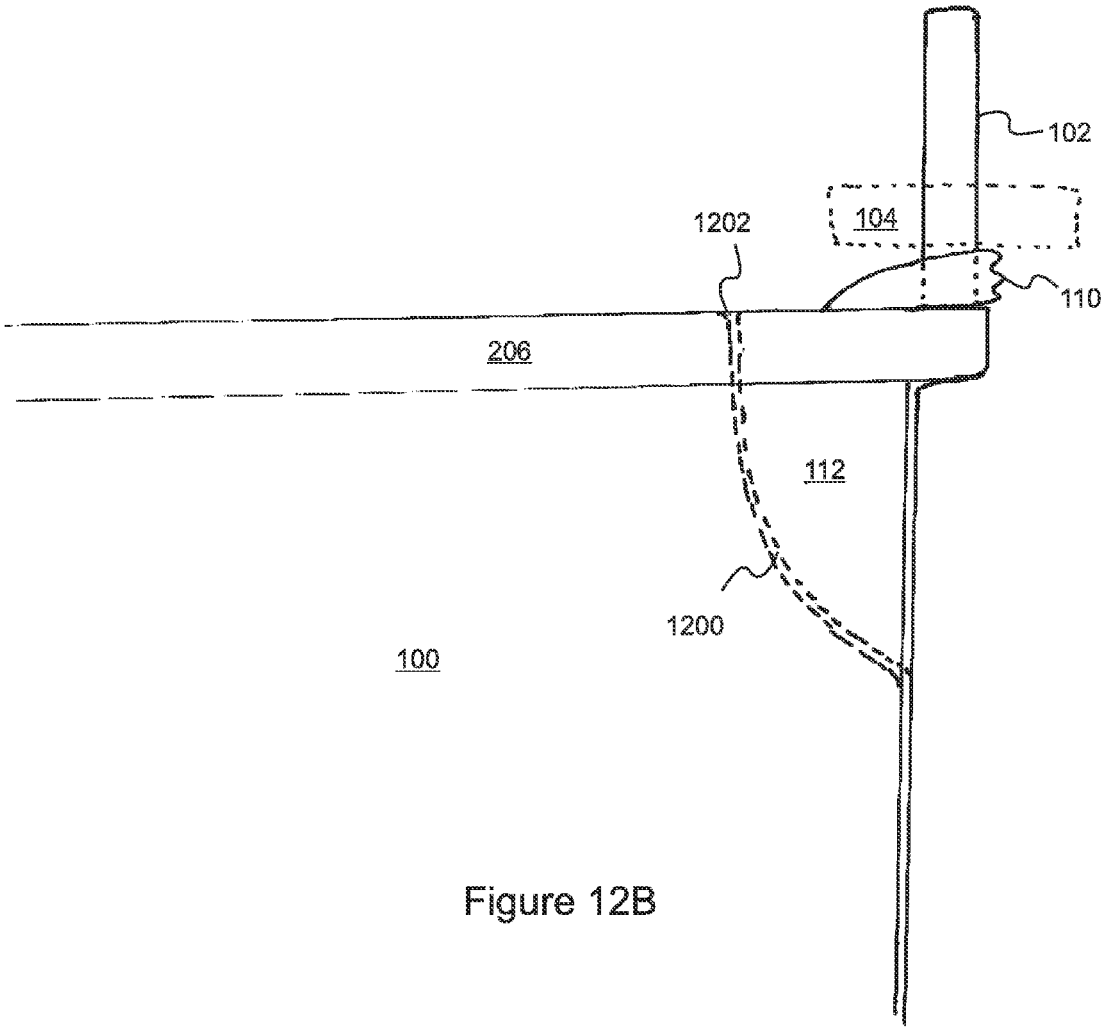
FIG. 12B is a side view of the embodiment of FIG. 12A.

With reference to FIG. 12A, in other embodiments portions 1202 of the receptacle rim which would otherwise 1204 be immediately below the BHBH's 102 are horizontally offset either inward or outward from the BHBH's 102, so that a grasping space 112 is formed directly beneath the suspended handles 110 of a shopping bag 108. In the embodiment of FIG. 12A, portions 1202 of the receptacle rim 206 which would otherwise be directly beneath the BHBH's 102 are offset toward the interior of the trash receptacle 100, creating indentations 1200 in the sides of the trash receptacle 100 and providing an open space 112 beneath the suspended handles 110 of the shopping bag 108. FIG. 12B is a side view of the embodiment of FIG. 12A.

The foregoing description of the embodiments of the invention has been presented for the purposes of illustration and description. It is not intended to be exhaustive or to limit the invention to the precise form disclosed. Many modifications and variations are possible in light of this disclosure. It is intended that the scope of the invention be limited not by this detailed description, but rather by the claims appended hereto.

What is claimed is:

1. A system for suspending a plastic shopping bag as a liner within a trash receptacle, the system comprising:

a trash receptacle having an interior that is bounded in a downward vertical direction by a horizontal base, the interior being bounded in all horizontal directions by a substantially vertical side wall, the side wall being attached along a bottom edge thereof to a periphery of the horizontal base, the vertical side wall being substantially perpendicular to the horizontal base, the interior being accessible through its top, the top of the interior being bounded by a top edge of the side wall;

at least two receptacle handles at least attachable to the trash receptacle and extending from the trash receptacle at two opposing locations around a rim of the trash receptacle, the receptacle handles being usable for lifting and carrying the trash receptacle, the receptacle handles being of a size and shape which allows bag handles of the plastic shopping bag to be placed over the receptacle handles and suspended thereby, so that the plastic shopping bag is positioned within the interior of the trash receptacle; and bag handle separating features that are at least cooperative with the receptacle handles, the bag handle separating features being configured, when the plastic shopping bag is full and the bag handles are under tension, to separate a central portion of each of the suspended plastic shopping bag handles from the rim of the trash receptacle, from the sides and all other structures included in the trash receptacle, from the receptacle handles and the bag handle separating features, and from all other regions of the plastic shopping bag, thereby enabling all four fingers of a user's hands to completely surround the central portions of the suspended shopping bag handles without disturbing the positions of the shopping bag handles and without making contact with any portion of the trash receptacle, the receptacle handles, the bag handle separating features, or any other region of the plastic shopping bag.

2. The system of claim 1, wherein each receptacle handle includes a plurality of receptacle handle posts configured to extend outward from the rim of the trash receptacle.

3. The system of claim 2, wherein the receptacle handle posts included in each receptacle handle are mechanically coupled to each other.

4. The system of claim 1, wherein the bag handle separating features include lobes which extend outward from sides of the receptacle handles and suspend the handles of the plastic shopping bag in a location that is vertically offset above the rim of the trash receptacle.

5. The system of claim 1, wherein the receptacle handles are formed as part of the trash receptacle.

6. The system of claim 1, wherein a mounting mechanism of the receptacle handles does not obstruct nesting of a plurality of trash receptacles by more than one inch when the receptacle handles are not attached to the trash receptacles.

7. The system of claim 1, wherein the receptacle handles are attached to a rim adaptor, the rim adaptor being able to at least rest on top of the rim of the trash receptacle, the rim adaptor having a central opening through which the plastic shopping bag can extend from the receptacle handles through the rim adaptor and into the interior of the trash receptacle.

8. The system of claim 7, wherein the rim adaptor includes an adaptor region surrounding the opening, the adaptor region being configured to enable the rim adaptor to at least rest on trash receptacle rims having at least one dimension which varies over a range of at least 10%.

9. The system of claim 7, further comprising a rim adaptor attachment mechanism adapted for attaching the rim adaptor to the rim of the trash receptacle.

10. The system of claim 9, wherein the rim adaptor attachment mechanism is adjustable so as to attach the rim adaptor to trash receptacle rims having at least one dimension which varies over a range of at least 10%.

11. The system of claim 1, wherein each of the receptacle handles includes a hinge about which the receptacle handle can pivot when the receptacle handle is attached to the trash receptacle and released for pivoting, the handle being unable to pivot about the hinge when it is locked in position.

12. The system of claim 11, wherein the receptacle extensions can pivot toward the interior of the trash receptacle.

13. The system of claim 11, wherein the receptacle handles can pivot away from the interior of the trash receptacle.

14. The system of claim 11, further comprising:

a locking mechanism cooperative with at least one of the receptacle handles, the locking mechanism being able to maintain the receptacle handle in a fixed orientation; and a release trigger which can be actuated so as to release the locking mechanism and allow the receptacle handle to pivot.

15. The system of claim 14, wherein the release trigger is positioned in a location that allows the release trigger to be actuated by a hand of a user while the hand is lifting a bag handle off of the receptacle handle.

16. The system of claim 14, wherein the release trigger is positioned in a location which allows the release trigger to be actuated by a foot of a user while a hand of the user is lifting a bag handle off of the receptacle handle.

17. The system of claim 1, further comprising a lid which can be closed so as to cover the trash receptacle, the receptacle handles being configured so as not to interfere with operation of the lid.

18. The system of claim 17, further comprising a foot pedal which is configured to open and close the lid by applying and removing foot pressure to the foot pedal.

19. The system of claim 1, further comprising a grasping feature of the receptacle handles, the grasping feature including a plurality of indentations configured so as to allow fingers of a user to rest therein.

20. The system of claim 1, further comprising a pair of side flaps which are at least attachable to opposing inner sides of the trash receptacle and which are able to overlap opposing side portions of a rim of a shopping bag so as to hold the shopping bag open when the shopping bag is suspended within the trash receptacle.

21. The system of claim 1, wherein the bag handle separating features include a shape feature of the rim of the trash receptacle that is cooperative with a receptacle handle so as to separate a shopping bag handle suspended by the receptacle extension from the rim of the trash receptacle.

22. The system of claim 21, wherein the shape feature includes a vertical recession of a portion of the rim of the trash receptacle directly beneath the receptacle handle that separates the shopping bag handle from the rim of the trash receptacle.

23. The system of claim 22, wherein the receptacle handle includes a border which covers the recessed portion of the rim of the trash receptacle.

24. The system of claim 21, wherein the shape feature includes a horizontal offset of a portion of the rim of the trash receptacle which would otherwise be beneath the receptacle handle.

25. A system for suspending a plastic shopping bag as a liner within a trash receptacle, the system comprising:

a rim adaptor, the rim adaptor being able to at least rest on top of a rim of a trash receptacle, the rim adaptor having a central opening through which a plastic shopping bag can extend through the rim adaptor and into an interior of the trash receptacle;

at least two receptacle handles at least attachable to the rim adaptor and extending from the rim adaptor at two opposing locations around the rim adaptor, the receptacle handles being usable for lifting and carrying the rim adaptor, the receptacle handles being of a size and shape which allows bag handles of the plastic shopping bag to be placed over the receptacle handles so as to position the plastic shopping bag through the central opening of the rim adaptor and into an interior of the trash receptacle; and bag handle separating features at least cooperative with the receptacle handles, the handle separating features being configured, when the plastic shopping bag is full and the bag handles are under tension, to provide a grasping space between the rim adaptor and the bag handles into which all four fingers of a user's hands can be inserted so as to surround the bag handles without disturbing the positions of the bag handles, and without making contact with any portion of the trash receptacle, the rim adaptor, the receptacle handles, the bag handle separating features, or any other region of the plastic shopping bag.

26. The system of claim 25, wherein the rim adaptor includes an adaptor region surrounding the opening, the adaptor region being configured to enable the rim adaptor to at least rest on trash receptacle rims having at least one dimension which varies over a range of at least 10%.

27. The system of claim 25, further comprising a rim adaptor attachment mechanism adapted for attaching the rim adaptor to the rim of a trash receptacle.

28. The system of claim 25, wherein the rim adaptor attachment mechanism is adjustable so as to attach the rim adaptor to trash receptacle rims having at least one dimension which varies over a range of at least 10%.

* * * * *